US012129595B2

(12) United States Patent
Gotou et al.

(10) Patent No.: US 12,129,595 B2
(45) Date of Patent: Oct. 29, 2024

(54) WATER REPELLENT AGENT COMPOSITION AND METHOD FOR PRODUCING WATER REPELLENT FIBER PRODUCT

(71) Applicants: NICCA CHEMICAL CO., LTD., Fukui (JP); Dow Toray Co., Ltd., Tokyo (JP)

(72) Inventors: Akihiro Gotou, Fukui (JP); Kazuhiko Kojima, Ichihara (JP); Seiji Hori, Ichihara (JP)

(73) Assignees: NICCA CHEMICAL CO., LTD., Fukui (JP); Dow Toray Co., Ltd., Tokyo (JP)

( * ) Notice: Subject to any disclaimer, the term of this patent is extended or adjusted under 35 U.S.C. 154(b) by 691 days.

(21) Appl. No.: 17/413,487

(22) PCT Filed: Dec. 17, 2019

(86) PCT No.: PCT/JP2019/049498
§ 371 (c)(1),
(2) Date: Jun. 11, 2021

(87) PCT Pub. No.: WO2020/130002
PCT Pub. Date: Jun. 25, 2020

(65) Prior Publication Data

US 2022/0074131 A1 Mar. 10, 2022

(30) Foreign Application Priority Data

Dec. 21, 2018 (JP) ..... 2018-240015

(51) Int. Cl.
*D06M 13/332* (2006.01)
*D06M 15/643* (2006.01)

(52) U.S. Cl.
CPC ..... *D06M 13/332* (2013.01); *D06M 15/643* (2013.01); *D06M 2200/12* (2013.01)

(58) Field of Classification Search
CPC ..... D06M 13/332; D06M 15/643; D06M 2200/12; D06M 13/325; D06M 15/6436; D06M 15/263; D06M 15/248; C09K 3/18
See application file for complete search history.

(56) References Cited

U.S. PATENT DOCUMENTS 4,070,152 A 1/1978 Pentz
4,748,166 A * 5/1988 Gautier ..... C08K 5/54 524/404
6,528,576 B1 3/2003 Meier et al.

FOREIGN PATENT DOCUMENTS

CN 1813097 A 8/2006
CN 105074081 A 11/2015
CN 106480741 A 3/2017
CN 108867086 A 11/2018
EP 2 683 869 B1 3/2017
JP 48-50099 A 7/1973
JP S63-170484 A 7/1988
JP H1-162877 A 6/1989
JP 2004-59609 A 2/2004
JP 2005-330354 A 12/2005
JP 2006-328624 A 12/2006
JP 2009-132933 A 6/2009
JP 2012052053 A * 3/2012
JP 2016-30763 A 3/2016
JP 2017-226946 A 12/2017
JP 2019-173185 A 10/2019
WO WO 2005/003436 A1 1/2005
WO WO 2014/148368 A1 9/2014
(Continued)

OTHER PUBLICATIONS

Abstract of Japan Patent Specification No. JP 48050099 A (Year: 1971).*
(Continued)

*Primary Examiner* — Anthony J Green
(74) *Attorney, Agent, or Firm* — Leydig, Voit & Mayer, Ltd.

(57) ABSTRACT

A water repellent agent composition contains a compound represented by the following General Formula (1) and a silicone resin:

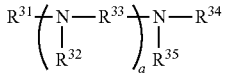

(1)

wherein in Formula (1), $R^{31}$ represents a monovalent hydrocarbon group having 4 to 30 carbon atoms, $R^{32}$ represents a hydrogen, a monovalent hydrocarbon group having 1 to 30 carbon atoms, or an organic group represented by —$R^{36}$—N($R^{37}$)—$R^{38}$ (in the formula, $R^{36}$ represents a divalent hydrocarbon group having 1 to 30 carbon atoms, and $R^{37}$ and $R^{38}$ each independently represent a hydrogen or a monovalent hydrocarbon group having 1 to 30 carbon atoms), $R^{33}$ represents a divalent hydrocarbon group having 1 to 30 carbon atoms, $R^{34}$ and $R^{35}$ each independently represent a hydrogen or a monovalent hydrocarbon group having 1 to 30 carbon atoms, a represents an integer of 0 to 2, and when a is 2, the plurality of $R^{32}$ and $R^{33}$ each may be identical or different.

4 Claims, No Drawings

(56) References Cited

FOREIGN PATENT DOCUMENTS

WO WO 2017/006849 A1 1/2017

OTHER PUBLICATIONS

International Search Report in counterpart International Patent Application PCT/JP2019/049498, mailed on Mar. 17, 2020.
International Bureau, Translation of the International Preliminary Report on Patentability and Written Opinion in counterpart International Patent Application No. PCT/JP2019/049498, mailed on Jul. 1, 2021.

* cited by examiner

WATER REPELLENT AGENT COMPOSITION AND METHOD FOR PRODUCING WATER REPELLENT FIBER PRODUCT

CROSS-REFERENCE TO RELATED APPLICATIONS

This patent application is the U.S. National Stage of International Patent Application No. PCT/JP2019/049498, filed Dec. 17, 2019, which claims the benefit of Japanese Patent Application No. 2018-240015, filed Dec. 21, 2018, which are each incorporated by reference.

TECHNICAL FIELD

The present invention relates to a water repellent agent composition and a method for producing a water-repellent textile product.

BACKGROUND ART

Fluorinated water repellent agents having fluorine groups are conventionally known, and textile products imparted with water repellency on the surface, which are produced by treating textile products or the like with such fluorinated water repellent agents, are known. Such fluorinated water repellent agents are generally produced by polymerizing or copolymerizing a monomer having a fluoroalkyl group. Textile products that have been treated with fluorinated water repellent agents exhibit excellent water repellency; however, monomers having fluoroalkyl groups have an environmental problem since the monomers are low degradability.

Thus, in recent years, research on non-fluorinated water repellent agents that do not contain fluorine is underway. For example, Patent Literature 1 described below proposes a water repellent agent composed of a specific non-fluorinated polymer containing, as a monomer unit, a (meth)acrylic acid ester having 12 or more carbon atoms in the ester moiety. Furthermore, Patent Literature 2 described below proposes a soft water repellent agent containing amino-modified silicone and a polyfunctional isocyanate compound. Patent Literature 3 described below proposes a water repellent agent composition containing amino-modified silicone, a silicone resin, and a polyfunctional isocyanate compound.

CITATION LIST

Patent Literature

Patent Literature 1: Japanese Unexamined Patent Publication No. 2006-328624

Patent Literature 2: Japanese Unexamined Patent Publication No. 2004-059609

Patent Literature 3: Japanese Unexamined Patent Publication No. 2017-226946

SUMMARY OF INVENTION

Technical Problem

From aspects of practical use and actual wearing, there is a demand for further enhancing the water repellency of the non-fluorinated water repellent agent without the texture of the textile product being impaired. Therefore, there is also need for improvement in the water repellent agent described in Patent Literature 1 described above.

In regard to the silicone-based soft water repellent agent described in Patent Literature 2 described above, satisfactory texture is obtainable; however, there are problems in that sufficient water repellency performance is difficult to obtain, initial water repellency and durable water repellency that the water repellency can be sufficiently maintained particularly even after washing are difficult to obtain.

However, in water-repelling textile products and the like, predetermined parts may be subjected to processing of coating with a urethane resin, an acrylic resin, or the like. It is required that, while the textile products in this case have sufficient water repellency, coating is less likely to be peeled off in the parts to be coated. The resistance to peeling of coating can be evaluated by measuring a stress (peeling strength) necessary for peeling a coating film from a water-repelling textile product; however, such a peeling strength of the conventional non-fluorinated water repellent agents has not been sufficiently studied, and there is a room for further improvement in order to achieve a balance between performance and the peeling strength in the above-described aspects of practical use and actual wearing in a higher level.

The present invention is conceived in view of the above-described circumstances, and an object thereof is to provide a water repellent agent composition by which a water-repellent textile product, which is excellent in water repellency, durable water repellency, and texture and can have a sufficient peeling strength with respect to a coating film, can be obtained, and a method for producing a water-repellent textile product using the same.

Solution to Problem

The present inventors have conducted intensive studies in order to solve the above-described problems, and as a result, the present inventors have found that, by treating fibers with a treatment liquid obtained by combining and mixing a specific amine compound and a silicone resin, a water-repellent textile product excellent in water repellency, durable water repellency, and texture and having a sufficient peeling strength with respect to a coating film can be obtained, thereby completing the present invention on the basis of that finding.

The present invention provides a water repellent agent composition containing a compound represented by the following General Formula (1) and a silicone resin.

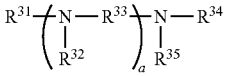

(1)

wherein in Formula (1), $R^{31}$ represents a monovalent hydrocarbon group having 4 to 30 carbon atoms, $R^{32}$ represents a hydrogen, a monovalent hydrocarbon group having 1 to 30 carbon atoms, or an organic group represented by —$R^{36}$—N($R^{37}$)—$R^{38}$ (in the formula, $R^{36}$ represents a divalent hydrocarbon group having 1 to 30 carbon atoms, and $R^{37}$ and $R^{38}$ each independently represent a hydrogen or a monovalent hydrocarbon group having 1 to 30 carbon atoms), $R^{33}$ represents a divalent hydrocarbon group having 1 to 30 carbon atoms, $R^{34}$ and $R^{35}$ each independently represent a hydrogen or a monovalent hydrocarbon group having 1 to 30 carbon atoms, a represents an integer of 0 to 2, and when a is 2, the plurality of $R^{32}$ and $R^{33}$ each may be identical or different.

By treating fibers with a treatment liquid including the water repellent agent composition according to the present invention, a water-repellent textile product excellent in water repellency, durable water repellency, and texture and having a sufficient peeling strength with respect to a coating film can be obtained. Furthermore, according to the water repellent agent composition related to the present invention, it is possible to obtain a water-repellent textile product also excellent in seam slippage property that corresponds to performance of preventing a phenomenon in which a seam is opened during wearing. The reason why such an effect is obtained is considered that the fibers can also be suppressed from being excessively stretched and being excessively hardened by combination of the components described above.

From the viewpoint of further improving the water repellency and the durable water repellency of the water-repellent textile product thus obtainable, a melting point or freezing point of the compound represented by the above General Formula (1) may be 40° C. to 70° C.

The present invention further provides a method for producing a water-repellent textile product, the method including a step of treating fibers with a treatment liquid including the above-described water repellent agent composition according to the present invention.

According to the method for producing a water-repellent textile product of the present invention, a water-repellent textile product excellent in water repellency, durable water repellency, and texture and having a sufficient peeling strength with respect to a coating film can be stably produced. Furthermore, a water-repellent textile product produced by the method of the present invention may be excellent in seam slippage property.

Advantageous Effects of Invention

According to the present invention, it is possible to provide a water repellent agent composition by which a water-repellent textile product excellent in water repellency, durable water repellency, and texture and having a sufficient peeling strength with respect to a coating film can be obtained. Furthermore, according to the water repellent agent composition of the present invention, excellent seam slippage property can be imparted to a textile product or the like.

DESCRIPTION OF EMBODIMENTS

Hereinafter, suitable embodiments of the present invention will be described in detail. However, the present invention is not intended to be limited to the embodiments described below.

A water repellent agent composition of the present embodiment contains a compound represented by General Formula (1) described below {hereinafter, also referred to as a compound (1) in some cases} and a silicone resin {hereinafter, also referred to as a component (I) in some cases}.

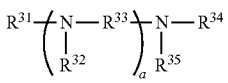

(1)

wherein in Formula (1), $R^{31}$ represents a monovalent hydrocarbon group having 4 to 30 carbon atoms, $R^{32}$ represents a hydrogen, a monovalent hydrocarbon group having 1 to 30 carbon atoms, or an organic group represented by —$R^{36}$—N($R^{37}$)—$R^{38}$ (in the formula, $R^{36}$ represents a divalent hydrocarbon group having 1 to 30 carbon atoms, and $R^{37}$ and $R^{38}$ each independently represent a hydrogen or a monovalent hydrocarbon group having 1 to 30 carbon atoms), $R^{33}$ represents a divalent hydrocarbon group having 1 to 30 carbon atoms, $R^{34}$ and $R^{35}$ each independently represent a hydrogen or a monovalent hydrocarbon group having 1 to 30 carbon atoms, a represents an integer of 0 to 2, and when a is 2, the plurality of $R^{32}$ and $R^{33}$ each may be identical or different.

<Compound (1)>

$R^{31}$ is preferably a linear or branched monovalent hydrocarbon group from the viewpoints of water repellency, durable water repellency, emulsifiability, and peeling strength. As for $R^{31}$, the number of carbon atoms of the hydrocarbon group is more preferably 8 to 26 and further preferably 12 to 24, from the viewpoints of water repellency, durable water repellency, emulsifiability, and peeling strength. Examples of the monovalent hydrocarbon group include an alkyl group and an alkenyl group. $R^{31}$ is more preferably an alkyl group having 12 to 26 carbon atoms or an alkenyl group having 12 to 26 carbon atoms, further preferably an alkyl group having 12 to 24 carbon atoms or an alkenyl group having 12 to 24 carbon atoms, and particularly preferably an alkyl group having 16 to 22 carbon atoms, from the viewpoints of water repellency, durable water repellency, emulsifiability, and peeling strength.

In a case in which $R^{32}$ is a monovalent hydrocarbon group, the number of carbon atoms of the hydrocarbon group is preferably 1 to 22 and more preferably 1 to 4, from the viewpoints of water repellency, durable water repellency, and emulsifiability. Examples of the monovalent hydrocarbon group include an alkyl group and an alkenyl group. $R^{32}$ is preferably a hydrogen or a monovalent hydrocarbon group having 1 to 22 carbon atoms, more preferably a hydrogen or a monovalent hydrocarbon group having 1 to 4 carbon atoms, and further preferably a hydrogen, an alkyl group having 1 to 4 carbon atoms, or an alkenyl group having 2 to 4 carbon atoms, from the viewpoints of water repellency, durable water repellency, and emulsifiability.

As for $R^{36}$, the number of carbon atoms of the hydrocarbon group is preferably 1 to 22 and more preferably 1 to 4, from the viewpoint of the emulsifiability of the compound (1). Examples of the divalent hydrocarbon group include an alkylene group. $R^{36}$ is preferably an alkylene group having 1 to 4 carbon atoms.

In a case in which $R^{37}$ and $R^{38}$ are a monovalent hydrocarbon group, the number of carbon atoms of $R^{37}$ and $R^{38}$ is preferably 1 to 22 from the viewpoint of the emulsifiability of the compound (1). $R^{37}$ and $R^{38}$ are preferably a hydrogen or a hydrocarbon group having 1 to 22 carbon atoms from the viewpoint of the emulsifiability of the compound (1).

As for $R^{33}$, the number of carbon atoms of the hydrocarbon group is preferably 1 to 22 and more preferably 1 to 4, from the viewpoint of the emulsifiability of the compound (1). Examples of the divalent hydrocarbon group include an alkylene group. $R^{33}$ is preferably an alkylene group having 1 to 4 carbon atoms.

In a case in which $R^{34}$ and $R^{35}$ are a monovalent hydrocarbon group, examples of the monovalent hydrocarbon group include an alkyl group and an alkenyl group. The number of carbon atoms of the monovalent hydrocarbon group is preferably 1 to 22 and more preferably 1 to 8. At least one of $R^{34}$ and $R^{35}$ are preferably a hydrogen or a monovalent hydrocarbon group having 1 to 22 carbon atoms and more preferably a hydrogen, an alkyl group having 1 to 22 carbon atoms, or an alkenyl group having 2 to 22 carbon atoms, from the viewpoints of the water repellency, the durable water repellency, and the emulsifiability of the compound (1). At least one of $R^{34}$ and $R^{35}$ are preferably a hydrogen or a monovalent hydrocarbon group having 1 to 8 carbon atoms and more preferably a hydrogen, an alkyl group having 1 to 8 carbon atoms, or an alkenyl group having 2 to 8 carbon atoms, from the viewpoints of the water repellency, the durable water repellency, and the emulsifiability of the compound (1). From the viewpoints of the water repellency, the durable water repellency, and the emulsifiability of the compound (1), it is preferable that one of $R^{34}$ and $R^{35}$ is a hydrogen or a monovalent hydrocarbon group having 1 to 22 carbon atoms, and the other one is a hydrogen or a monovalent hydrocarbon group having 1 to 8 carbon atoms; it is more preferable that one of these is a hydrogen, an alkyl group having 1 to 22 carbon atoms, or an alkenyl group having 2 to 22 carbon atoms, and the other one is a hydrogen or a monovalent hydrocarbon group having 1 to 8 carbon atoms, or one of these is a hydrogen or a monovalent hydrocarbon group having 1 to 22 carbon atoms, and the other one is a hydrogen, an alkyl group having 1 to 8 carbon atoms, or an alkenyl group having 2 to 8 carbon atoms; it is further preferable that one of these is a hydrogen, an alkyl group having 1 to 22 carbon atoms, or an alkenyl group having 2 to 22 carbon atoms, and the other one is a hydrogen, an alkyl group having 1 to 8 carbon atoms, or an alkenyl group having 2 to 8 carbon atoms; it is particularly preferable that one of these is a hydrogen, an alkyl group having 1 to 22 carbon atoms, or an alkenyl group having 2 to 22 carbon atoms, and the other one is a hydrogen; and it is most preferable that both are a hydrogen.

a is preferably 0 or 1 from the viewpoint of the emulsifiability of the compound (1).

From the viewpoint of further improving the water repellency and the durable water repellency of the water-repellent textile product thus obtainable, the melting point or freezing point of the compound (1) is preferably 40° C. to 70° C. and more preferably 50° C. to 70° C. Furthermore, from the viewpoint of improving the temporal stability of the water-repellent textile product thus obtainable, the melting point or freezing point of the compound (1) is preferably lower than 40° C., more preferably 5° C. or higher and lower than 40° C., further preferably 10° C. or higher and lower than 40° C., and particularly preferably 20° C. or higher and lower than 40° C. The melting point of the compound (1) is measured by the method according to "3.1 Method based on visual inspection" of JIS K 0064-1992. The freezing point of the compound (1) is measured by the method according to JIS K 0065-1992.

The water repellent agent composition of the present embodiment may contain a combination of a compound (1) having a melting point or freezing point of 40° C. to 70° C. and a compound (1) having a melting point or freezing point of lower than 40° C.

Examples of the compound (1) include laurylamine, stearylamine, cetylamine, oleylamine, behenylamine, 3-(stearylamino)propylamine, distearylamine, and octylamine.

As the compound (1), commercially available products such as "LIPOMIN 12D", "LIPOMIN HTD", "LIPOMIN 2HT", "LIPOMIN DM22D", "LIPOMIN DA-T", "TRIAMEEN T", and "TRIAMEEN Y12D" manufactured by Lion Specialty Chemicals Co., Ltd., "NISSANAMINE PB", "NISSANAMINE AB", "NISSANAMINE VB", "TERTIARY NISSANAMINE AB", and "NISSANAMINE DT-H" manufactured by NOF CORPORATION, "FARIVIIN 08D", "FARMIN 20D", "FARMIN DM8680", and "DIAMIN R-86" manufactured by Kao Corporation, and "C3090" and "C3130" manufactured by KOEI CHEMICAL COMPANY, LIMITED can be used.

<Silicone Resin>

It is preferable that the silicone resin is organopolysiloxane containing MQ, MDQ, MT, MTQ, MDT, or MDTQ as a constituent, being a solid form at 25° C., and having a three-dimensional structure. Furthermore, the hardness of the silicone resin, which is measured by the Type A durometer according to JIS K 6249:2003 13. Hardness Test, is preferably 20 or more and more preferably 60 or more. Herein, M, D, T, and Q represent a $(R'')_3SiO_{0.5}$ unit, a $(R'')_2SiO$ unit, a $R''SiO_{1.5}$ unit, and a $SiO_2$ unit, respectively. R" represents a monovalent aliphatic hydrocarbon group having 1 to 10 carbon atoms or a monovalent aromatic hydrocarbon group having 6 to 15 carbon atoms.

The silicone resin is generally known as an MQ resin, an MT resin, or an MDT resin, and has a moiety shown by MDQ, MTQ, or MDTQ in some cases.

The silicone resin is also available as a solution obtained by dissolving the silicone resin in alkylpolysiloxane or an appropriate solvent other than alkylpolysiloxane. Examples of the solvent other than alkylpolysiloxane include hydrocarbons such as n-hexane, cyclohexane, isoparaffin, and liquid paraffin, isopropyl alcohol, and a mixture of these solvents.

The alkylpolysiloxane is a compound in which a side chain and a terminal of chain-like organopolysiloxane are a saturated hydrocarbon group or a compound in which the side chain of cyclic organopolysiloxane is a saturated hydrocarbon group. Examples of the alkylpolysiloxane include a compound represented by General Formula (2) described below {hereinafter, also referred to as a compound (2) in some cases} and a compound represented by General Formula (3) described below {hereinafter, also referred to as a compound (3) in some cases}.

(2)

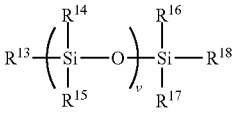

wherein in Formula (2), $R^{13}$, $R^{14}$, $R^{15}$, $R^{16}$, $R^{17}$, and $R^{18}$ each independently represent a monovalent saturated hydrocarbon group having 1 to 18 carbon atoms, and v represents an integer of 1 or larger.

(3)

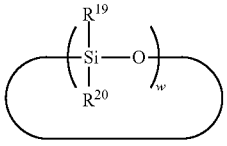

wherein in Formula (3), $R^{19}$ and $R^{20}$ each independently represent a monovalent saturated hydrocarbon group having 1 to 18 carbon atoms, and w represents an integer from 2 to 20.

In the compound (2) which is used for the present embodiment, $R^{13}$, $R^{14}$, $R^{15}$, $R^{16}$, $R^{17}$, and $R^{18}$ each independently represent a monovalent saturated hydrocarbon group having 1 to 18 carbon atoms. The number of carbon atoms of the saturated hydrocarbon group is preferably 1 to 10, from the viewpoints that the silicone resin is easily dissolved in the compound (2) and the compound is easily available. The saturated hydrocarbon group may be linear or branched. The saturated hydrocarbon group is preferably linear and more preferably a linear alkyl group. The saturated hydrocarbon group is preferably a methyl group or an ethyl group, and more preferably a methyl group. v represents an integer of 1 or larger. v can be selected as appropriate such that the kinetic viscosity of the compound (2) is in the range of the kinetic viscosity of the alkylpolysiloxane described below.

Examples of the compound (2) include dimethylpolysiloxane and diethylpolysiloxane.

In the compound (3) which is used for the present embodiment, $R^{19}$ and $R^{20}$ each independently represent a monovalent saturated hydrocarbon group having 1 to 18 carbon atoms. The number of carbon atoms of this saturated hydrocarbon group is preferably 1 to 10. In a case in which the number of carbon atoms of the saturated hydrocarbon group is within the range described above, there is a tendency that the silicone resin is easily dissolved in the compound (3) and the compound is easily available. The saturated hydrocarbon group may be linear or branched. The saturated hydrocarbon group is preferably linear and more preferably a linear alkyl group. The saturated hydrocarbon group is preferably a methyl group or an ethyl group, and more preferably a methyl group. w represents an integer from 2 to 20. w is preferably 3 to 10 and more preferably 4 or 5. In a case in which w is within the range described above, there is a tendency that the silicone resin is easily dissolved in the compound (3) and the compound is easily available.

Examples of the compound (3) include decamethyl cyclopentasiloxane and octamethyl cyclotetrasiloxane.

Regarding the alkylpolysiloxane, one kind may be used alone, or two or more kinds thereof may be used in combination.

The alkylpolysiloxane is preferably in a liquid form at 25° C. The kinetic viscosity at 25° C. of the alkylpolysiloxane is preferably 0.1 to 100,000 $mm^2/s$, more preferably 0.1 to 10,000 $mm^2/s$, further preferably 0.1 to 1,000 $mm^2/s$, particularly preferably 0.1 to 500 $mm^2/s$, and most preferably 0.1 to 100 $mm^2/s$. In a case in which the kinetic viscosity at 25° C. is within the range described above, the silicone resin is easily dissolved in the alkylpolysiloxane and workability is easy to secure. The kinetic viscosity at 25° C. means a value measured by the method described in JIS K 2283:2000 (Uberode-type viscometer).

Examples of the solution obtained by dissolving the silicone resin in alkylpolysiloxane include KF7312J (mixture of trimethylsilyl group-containing polysiloxane: decamethyl cyclopentasiloxane=50:50), KF7312F (mixture of trimethylsilyl group-containing polysiloxane: octamethyl cyclotetrasiloxane=50:50), KF9021L (mixture of trimethylsilyl group-containing polysiloxane: low-viscosity methylpolysiloxane=50:50), and KF7312L (mixture of trimethylsilyl group-containing polysiloxane: low-viscosity methylpolysiloxane=50:50), which are commercially available from Shin-Etsu Chemical Co., Ltd.

Examples of the silicone resin alone include MQ-1600 solid Resin (trimethylsilyl group-containing polysiloxane) and MQ-1640 Flake Resin (trimethylsilyl group-containing polysiloxane, polypropylsilsesquioxane) commercially available from Dow Corning Toray Co., Ltd. The commercially available products contain trimethylsilyl group-containing polysiloxane and contain MQ, MDQ, MT, MTQ, MDT, or MDTQ.

The amount of the silicone resin mixed in the water repellent agent composition of the present embodiment may be 100,000 parts by mass or less with respect to 100 parts by mass of the compound (1), and from the viewpoints of further improving water repellency, durable water repellency, and peeling strength, the amount is preferably 20,000 parts by mass or less, more preferably 10,000 parts by mass or less, further preferably 5,000 parts by mass or less, and particularly preferably 4,000 parts by mass or less. The amount of the silicone resin mixed in the water repellent agent composition of the present embodiment may be 200 parts by mass or more with respect to 100 parts by mass of the compound (1), and from the viewpoints of further improving water repellency, durable water repellency, and peeling strength, the amount is preferably 500 parts by mass or more and more preferably 1,000 parts by mass or more.

Examples of the water repellent component other than the compound (1) and the component (I) include conventionally known fluorine-based polymers, and hydrocarbon group-containing compounds such as amino-modified silicone, aliphatic carboxylic acid, and esters thereof, polyolefin, and poly(meth)acrylic acid ester. In a case in which the water repellent agent composition contains water repellent components other than the compound (1) and the component (I), from the viewpoint of improving water repellency and texture, amino-modified silicone can be mixed in the range that peeling strength is not lowered.

Examples of the conventionally known fluorine-based polymers include NK GUARD 5-33 (manufactured by NICCA CHEMICAL CO., LTD.).

Examples of the amino-modified silicone include SF8417 (manufactured by Dow Corning Toray Co., Ltd.).

The aliphatic carboxylic acid may be saturated or unsaturated, and the number of carbon atoms is preferably 12 or more. Esters of such aliphatic carboxylic acid may be used.

Examples of the polyolefin include polyethylene, polypropylene, and an ethylene-propylene copolymer.

In regard to the poly(meth)acrylic acid ester, the number of carbon atoms of the hydrocarbon group existing via an ester bond is preferably 12 or more. Furthermore, the number of carbon atoms of the hydrocarbon group is preferably 24 or less. The hydrocarbon group may be linear or branched, may be saturated hydrocarbon or unsaturated hydrocarbon, and may have an alicyclic or aromatic cyclic form. Among these, it is preferable that the hydrocarbon group is linear, and it is more preferable that the hydrocarbon group is a linear alkyl group. The compositional proportion of the monomer of acrylic acid ester or methacrylic acid ester in such a polymer is preferably 80% to 100% by mass, with respect to the total amount of the monomer units that constitute the polymer. Furthermore, the weight average molecular weight of such a polymer is preferably 500,000 or more. Furthermore, a copolymer of acrylic acid ester and methacrylic acid ester may be used.

Examples of such poly(meth)acrylic acid ester (non-fluorinated polymer) include a non-fluorinated acrylic polymer containing a constituent unit derived from a (meth) acrylic acid ester monomer (A) represented by General Formula (A-1) described below (hereinafter, also referred to as "component (A)").

(A-1)

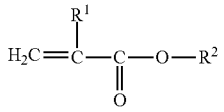

wherein in Formula (A-1), $R^1$ represents a hydrogen or a methyl group; and $R^2$ represents a monovalent hydrocarbon group having 12 or more carbon atoms which may have a substituent.

The (meth)acrylic acid ester monomer (A) represented by General Formula (A-1) described above, which is used for the present embodiment, has a monovalent hydrocarbon group having 12 or more carbon atoms which may have a substituent. This hydrocarbon group may be linear or branched, may be a saturated hydrocarbon group or an unsaturated hydrocarbon group, and may have an alicyclic or aromatic cyclic form. Among these, it is preferable that the hydrocarbon group is linear, and it is more preferable that the hydrocarbon group is a linear alkyl group. In this case, superior water repellency is obtained. In a case in which the monovalent hydrocarbon group having 12 or more carbon atoms has a substituent, the substituent may be one or more of a hydroxy group, an amino group, a carboxy group, an epoxy group, an isocyanate group, a blocked isocyanate group, a (meth)acryloyloxy group, and the like. In the present embodiment, it is preferable that $R^2$ in General Formula (A-1) described above is an unsubstituted hydrocarbon group.

The number of carbon atoms of the hydrocarbon group is preferably 12 to 24. If the number of carbon atoms is 12 or more, in a case in which the water repellent agent composition containing a non-fluorinated acrylic polymer is attached to a textile product or the like, water repellency is more easily enhanced. Meanwhile, if the number of carbon atoms is 24 or less, in a case in which the water repellent agent composition containing a non-fluorinated acrylic polymer is attached to a textile product or the like, the texture of the water-repellent textile product thus obtainable tends to be further enhanced.

The number of carbon atoms of the hydrocarbon group is more preferably 12 to 21. In a case in which the number of carbon atoms is in this range, especially excellent water repellency and texture are obtained. A particularly preferred hydrocarbon group is a linear alkyl group having 12 to 18 carbon atoms.

Examples of the component (A) include stearyl (meth) acrylate, cetyl (meth)acrylate, lauryl (meth)acrylate, dodecyl (meth)acrylate, myristyl (meth)acrylate, pentadecyl (meth)acrylate, heptadecyl (meth)acrylate, nonadecyl (meth)acrylate, eicosyl (meth)acrylate, heneicosyl (meth) acrylate, behenyl (meth)acrylate, ceryl (meth)acrylate, and melissyl (meth)acrylate.

The component (A) can have at least one functional group selected from the group consisting of a hydroxy group, an amino group, a carboxy group, an epoxy group, and an isocyanate group, all of which can react with a crosslinking agent. In this case, the durable water repellency of the water-repellent textile product thus obtainable can be further enhanced. The isocyanate group may form a blocked isocyanate group that is protected with a blocking agent. Furthermore, in a case in which the component (A) has an amino group, the texture of the water-repellent textile product thus obtainable can be further enhanced.

The component (A) is preferably a monofunctional (meth) acrylic acid ester monomer having one polymerizable unsaturated group in one molecule.

Regarding the component (A), one kind may be used alone, or two or more kinds thereof may be used in combination.

Regarding the component (A), it is preferable to use an acrylic acid ester monomer (a1) and a methacrylic acid ester monomer (a2) in combination, from the viewpoint of the durable water repellency of the water-repellent textile product thus obtainable. The ratio (a1)/(a2) of the mass of the component (a1) and the mass of the component (a2) that are mixed is preferably 30/70 to 90/10, more preferably 40/60 to 85/15, and even more preferably 50/50 to 80/20. In a case in which the ratio (a1)/(a2) is within the range described above, the water-repellent textile product thus obtainable acquires more satisfactory durable water repellency.

The total compositional proportion of the monomers of the component (A) in the non-fluorinated acrylic polymer is preferably 50% to 100% by mass, more preferably 55% to 100% by mass, and even more preferably 60% to 100% by mass, with respect to the total amount of the monomer components that constitute the non-fluorinated polymer, from the viewpoints of the water repellency and the durable water repellency of the water-repellent textile product thus obtainable.

It is preferable that the non-fluorinated acrylic polymer contains, in addition to the component (A), at least one reactive emulsifier (B) (hereinafter, also referred to as "component (B)") selected from among (B1) a compound represented by General Formula (I-1) described below and having a HLB of 7 to 18; (B2) a compound represented by General Formula (II-1) described below and having a HLB of 7 to 18; and (B3) a compound having a HLB of 7 to 18 and obtainable by adding an alkylene oxide having 2 to 4 carbon atoms to an oil or fat having a hydroxy group and a polymerizable unsaturated group, as a monomer component, from the viewpoint that the water repellency of the water-repellent textile product thus obtainable, and the emulsion stability in the composition during emulsion polymerization or dispersion polymerization and after polymerization of the non-fluorinated acrylic polymer can be further enhanced.

(I-1)

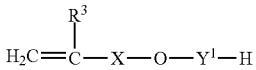

wherein in Formula (I-1), $R^3$ represents a hydrogen or a methyl group; X represents a linear or branched alkylene group having 1 to 6 carbon atoms; and $Y^1$ represents a divalent group including an alkyleneoxy group having 2 to 4 carbon atoms.

(II-1)

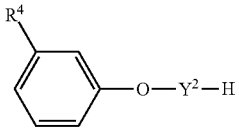

wherein in Formula (II-1), $R^4$ represents a monovalent unsaturated hydrocarbon group having 13 to 17 carbon atoms and having a polymerizable unsaturated group; and $Y^2$ represents a divalent group including an alkyleneoxy group having 2 to 4 carbon atoms.

The "reactive emulsifier" is an emulsion dispersant having radical reactivity, that is, a surfactant having one or more polymerizable unsaturated groups in the molecule, and can be copolymerized with a monomer such as a (meth)acrylic acid ester.

Furthermore, the "HLB" is a HLB value calculated by the Griffin method by considering an ethyleneoxy group as a hydrophilic group and all other groups as lipophilic groups.

The HLB values of the compounds of (B1) to (B3) used for the present embodiment are 7 to 18, and from the viewpoint of the emulsion stability in the composition during emulsion polymerization or dispersion polymerization and after polymerization of the non-fluorinated acrylic polymer (hereinafter, simply referred to as emulsion stability), the HLB values are preferably 9 to 15.

Furthermore, from the viewpoint of storage stability of the water repellent agent composition, it is more preferable to use two or more kinds of reactive emulsifiers (B) having different HLB values within the above-described range in combination.

In regard to the reactive emulsifier (B1) represented by General Formula (I-1) described above, which is used for the present embodiment, $R^3$ represents a hydrogen or a methyl group, and it is more preferable that $R^3$ is a methyl group in view of copolymerizability with the component (A). X represents a linear or branched alkylene group having 1 to 6 carbon atoms, and from the viewpoint of the emulsion stability of the non-fluorinated acrylic polymer of the present embodiment, a linear alkylene group having 2 or 3 carbon atoms is more preferred. $Y^1$ represents a divalent group including an alkyleneoxy group having 2 to 4 carbon atoms. The type, combination, and the number of addition of the alkyleneoxy group in $Y^1$ can be selected as appropriate such that the HLB value is within the range described above. Furthermore, in a case in which two or more kinds of alkyleneoxy groups are used, they can have a block addition structure or a random addition structure.

The compound represented by General Formula (I-1) described above is preferably a compound represented by General Formula (I-2) described below.

(I-2)

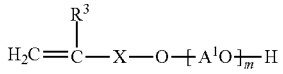

wherein in Formula (I-2), $R^3$ represents a hydrogen or a methyl group; X represents a linear or branched alkylene group having 1 to 6 carbon atoms; $A^1O$ represents an alkyleneoxy group having 2 to 4 carbon atoms; m can be selected as appropriate such that the HLB value is within the range described above, while specifically, m is preferably an integer from 1 to 80; and when m is 2 or more, m units of $A^1O$ may be identical or different.

In regard to the compound represented by General Formula (I-2) described above, $R^3$ represents a hydrogen or a methyl group, and it is more preferable that $R^3$ is a methyl group from the viewpoint of copolymerizability with the component (A). X represents a linear or branched alkylene group having 1 to 6 carbon atoms, and from the viewpoint of the emulsion stability of the non-fluorinated acrylic polymer, a linear alkylene group having 2 or 3 carbon atoms is more preferable. $A^1O$ represents an alkyleneoxy group having 2 to 4 carbon atoms. The type and combination of $A^1O$, and the number of m can be selected as appropriate such that the HLB value is within the range described above. From the viewpoint of the emulsion stability of the non-fluorinated acrylic polymer, m is preferably an integer from 1 to 80, and more preferably an integer from 1 to 60. When m is 2 or more, m units of $A^1O$ may be identical or different. Furthermore, in a case in which two or more kinds of $A^1O$ are used, they can have a block addition structure or a random addition structure.

The reactive emulsifier (B1) represented by General Formula (I-2) described above can be obtained by a conventionally known method and is not particularly limited. Furthermore, the reactive emulsifier (B1) is easily available from commercially available products, and examples may include "LATEMUL PD-420," "LATEMUL PD-430," and "LATEMUL PD-450" manufactured by Kao Corporation.

In regard to the reactive emulsifier (B2) represented by General Formula (II-1) described above, which is used for the present embodiment, $R^4$ represents a monovalent unsaturated hydrocarbon group having 13 to 17 carbon atoms and having a polymerizable unsaturated group, and examples include a tridecenyl group, a tridecadienyl group, a tetradecenyl group, a tetradienyl group, a pentadecenyl group, a pentadecadienyl group, a pentadecatrienyl group, a heptadecenyl group, a heptadecadienyl group, and a heptadecatrienyl group. From the viewpoint of the emulsion stability of the non-fluorinated polymer, $R^4$ is more preferably a monovalent unsaturated hydrocarbon group having 14 to 16 carbon atoms.

$Y^2$ represents a divalent group including an alkyleneoxy group having 2 to 4 carbon atoms. The type, combination, and the number of addition of the alkyleneoxy group for $Y^2$ can be selected as appropriate such that the HLB value is within the range described above. Furthermore, in a case in which two or more kinds of alkyleneoxy groups are used, they can have a block addition structure or a random addition structure. From the viewpoint of the emulsion stability of the non-fluorinated acrylic polymer, the alkyleneoxy group is more preferably an ethyleneoxy group.

The compound represented by General Formula (II-1) described above is preferably a compound represented by General Formula (II-2) described below.

(II-2)

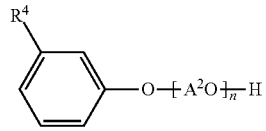

wherein in Formula (II-2), $R^4$ represents a monovalent unsaturated hydrocarbon group having 13 to 17 carbon atoms and having a polymerizable unsaturated group; $A^2O$ represents an alkyleneoxy group having 2 to 4 carbon atoms; n can be selected as appropriate such that the HLB value is within the range described above, while specifically, n is preferably an integer from 1 to 50; and when n is 2 or more, n units of $A^2O$ may be identical or different.

Examples of $R^4$ for the compound represented by General Formula (II-2) described above include groups similar to $R^4$ for the General Formula (II-1) described above.

$A^2O$ represents an alkyleneoxy group having 2 to 4 carbon atoms. In view of the emulsion stability of the non-fluorinated acrylic polymer, the type and combination of $A^2O$ and the number of n can be selected as appropriate such that the HLB value is within the range described above. In view of the emulsion stability of the non-fluorinated acrylic polymer, $A^2O$ is more preferably an ethyleneoxy group, and n is preferably an integer from 1 to 50, more preferably an integer from 5 to 20, and even more preferably an integer from 8 to 14. When n is 2 or more, n units of $A^2O$ may be identical or different. Furthermore, in a case in which two or more kinds of $A^2O$ are used, they can have a block addition structure or a random addition structure.

The reactive emulsifier (B2) represented by General Formula (II-2) described above, which is used for the present embodiment, can be synthesized by adding an alkylene oxide to a phenol having a corresponding unsaturated hydrocarbon group by a conventionally known method, and there are no particular limitations. For example, the reactive emulsifier (B2) can be synthesized by adding a predetermined amount of an alkylene oxide using an alkali catalyst such as caustic soda or caustic potash under pressure at 120° C. to 170° C.

The phenol having a corresponding unsaturated hydrocarbon group includes industrially produced pure products or mixtures, as well as pure products or mixtures extracted and purified from plants and the like. Examples include 3-[8(Z),11(Z),14-pentadecatrienyl]phenol, 3-[8(Z),11(Z)-pentadecadienyl]phenol, 3-[8(Z)-pentadecenyl]phenol, and 3-[11(Z)-pentadecenyl]phenol, which are extracted from cashew nut shell and the like and are collectively called cardanols.

The reactive emulsifier (B3) used for the present embodiment is a compound having a HLB of 7 to 18 and obtainable by adding an alkylene oxide having 2 to 4 carbon atoms to an oil or fat having a hydroxy group and a polymerizable unsaturated group. Examples of the oil or fat having a hydroxy group and a polymerizable unsaturated group may include mono- or diglycerides of fatty acids which may include unsaturated fatty acids (palmitoleic acid, oleic acid, linoleic acid, α-linolenic acid, arachidonic acid, eicosapentaenoic acid, docosapentaenic acid, and the like); and triglycerides of fatty acids including at least one hydroxy unsaturated fatty acid (ricinolic acid, ricinelaidic acid, 2-hydroxytetracosenoic acid, and the like). In view of the emulsion stability of the non-fluorinated polymer, an alkylene oxide adduct of a triglyceride of a fatty acid including at least one hydroxy unsaturated fatty acid is preferred; a C2-C4 alkylene oxide adduct of castor oil (triglyceride of fatty acids including ricinolic acid) is more preferred; and an ethylene oxide adduct of castor oil is even more preferred. Furthermore, the number of added moles of the alkylene oxide can be selected as appropriate such that the HLB value is within the range described above, and in view of the emulsion stability of the non-fluorinated acrylic polymer, the number of added moles is more preferably 20 to 50 moles, and even more preferably 25 to 45 moles. Furthermore, in a case in which two or more kinds of alkylene oxides are used, they can have a block addition structure or a random addition structure.

The reactive emulsifier (B3) used for the present embodiment can be synthesized by adding an alkylene oxide to an oil or fat having a hydroxy group and a polymerizable unsaturated group by a conventionally known method, and there are no particular limitations. For example, the reactive emulsifier (B3) can be synthesized by adding a predetermined amount of an alkylene oxide to triglycerides of fatty acids including ricinoleic acid, that is, castor oil, using an alkali catalyst such as caustic soda or caustic potash under pressure at 120° C. to 170° C.

From the viewpoint that the water repellency of the water-repellent textile product thus obtainable, and the emulsion stability of the non-fluorinated acrylic polymer can be further enhanced, the compositional proportion of the monomer of the component (B) in the non-fluorinated acrylic polymer is preferably 0.5% to 20% by mass, more preferably 1% to 15% by mass, and even more preferably 3% to 10% by mass, with respect to the total amount of the monomer components that constitute the non-fluorinated acrylic polymer.

From the viewpoint that the durable water repellency of the water-repellent textile product thus obtainable can be further enhanced, it is preferable that the non-fluorinated acrylic polymer contains, as a monomer component, at least one second (meth)acrylic acid ester monomer (C) (hereinafter, also referred to as "component (C)") selected from the group consisting of the following (C1), (C2), (C3), (C4), and (C5), in addition to the component (A).

(C1) is a (meth)acrylic acid ester monomer represented by General Formula (C-1) described below other than (C5).

(C-1)

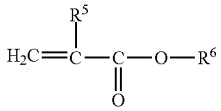

wherein in Formula (C-1), $R^5$ represents a hydrogen or a methyl group; and $R^6$ represents a monovalent chain-like hydrocarbon group having 1 to 11 carbon atoms and having at least one functional group selected from the group consisting of a hydroxy group, an amino group, a carboxy group, an epoxy group, an isocyanate group, and a (meth) acryloyloxy group, provided that the number of (meth) acryloyloxy groups in the molecule is 2 or less.

(C2) is a (meth)acrylic acid ester monomer represented by General Formula (C-2) described below.

(C-2)

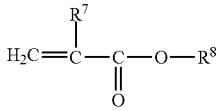

wherein in Formula (C-2), $R^7$ represents a hydrogen or a methyl group; and $R^8$ represents a monovalent cyclic hydrocarbon group having 1 to 11 carbon atoms which may have a substituent.

(C3) is a methacrylic acid ester monomer represented by General Formula (C-3) described below.

(C-3)

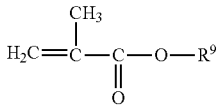

wherein in Formula (C-3), $R^9$ represents an unsubstituted monovalent chain-like hydrocarbon group having 1 to 4 carbon atoms.

(C4) is a (meth)acrylic acid ester monomer represented by General Formula (C-4) described below.

(C-4)

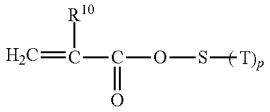

wherein in Formula (C-4), $R^{10}$ represents a hydrogen or a methyl group; p represents an integer of 2 or larger, S represents an organic group having a valence of (p+1); and T represents a monovalent organic group having a polymerizable unsaturated group.

(C5) is a (meth)acrylic acid ester monomer represented by General Formula (C-5) described below.

(C-5)

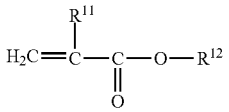

wherein in Formula (C-5), $R^{11}$ represents a hydrogen or a methyl group; and $R^{12}$ represents a monovalent chain-like saturated hydrocarbon group having 3 to 6 carbon atoms and having a hydroxy group and at least one functional group selected from the group consisting of a chloro group and a bromo group.

The monomer of (C1) is a (meth)acrylic acid ester monomer having a monovalent chain-like hydrocarbon group having 1 to 11 carbon atoms and having at least one functional group selected from the group consisting of a hydroxy group, an amino group, a carboxy group, an epoxy group, an isocyanate group, and a (meth)acryloyloxy group in the ester moiety and is a (meth)acrylic acid ester monomer other than (C5) described above. From the viewpoint of being capable of reacting with a crosslinking agent, it is preferable that the monovalent chain-like hydrocarbon group having 1 to 11 carbon atoms has at least one functional group selected from the group consisting of a hydroxy group, an amino group, a carboxy group, an epoxy group, and an isocyanate group. In a case in which a non-fluorinated acrylic polymer containing the monomer of (C1) having such a group that is capable of reacting with a crosslinking agent is used to treat a textile product together with a crosslinking agent, the durable water repellency can be further enhanced while the texture of the water-repellent textile product thus obtainable is maintained. The isocyanate group may be a blocked isocyanate group that is protected with a blocking agent.

The chain-like hydrocarbon group may be linear or branched, and may be a saturated hydrocarbon group or an unsaturated hydrocarbon group. Furthermore, the chain-like hydrocarbon group may further have a substituent other than the functional group. Above all, the chain-like hydrocarbon group is preferably a linear group, and/or a saturated hydrocarbon group, from the viewpoint that the durable water repellency of the water-repellent textile product thus obtainable can be further enhanced.

Specific examples of the monomer of (C1) include 2-hydroxyethyl (meth)acrylate, dimethylaminoethyl (meth)acrylate, glycidyl (meth)acrylate, and 1,1-bis(acryloyloxymethyl)ethyl isocyanate. These monomers may be used singly, or two or more kinds thereof may be used in combination. Among them, 2-hydroxyethyl (meth)acrylate, glycidyl (meth)acrylate, and 1,1-bis(acryloyloxymethyl)ethyl isocyanate are preferred from the viewpoint that the durable water repellency of the water-repellent textile product thus obtainable can be further enhanced. Furthermore, from the viewpoint of further enhancing the texture of the water-repellent textile product thus obtainable, dimethylaminoethyl (meth) acrylate is preferred.

The compositional proportion of the monomer of (C1) in the non-fluorinated acrylic polymer is preferably 1% to 30% by mass, more preferably 3% to 25% by mass, and even more preferably 5% to 20% by mass, with respect to the total amount of the monomer components that constitute the non-fluorinated acrylic polymer, from the viewpoints of the water repellency and the texture of the water-repellent textile product thus obtainable.

The monomer of (C2) is a (meth)acrylic acid ester monomer having a monovalent cyclic hydrocarbon group having 1 to 11 carbon atoms in the ester moiety, and examples of the cyclic hydrocarbon group include an isobornyl group, a cyclohexyl group, and a dicyclopentanyl group. These cyclic hydrocarbon groups may each have a substituent such as an alkyl group. However, in a case in which the substituent is a hydrocarbon group, a hydrocarbon group in which the sum total of the numbers of carbon atoms of the substituent and the cyclic hydrocarbon group is 11 or less is selected. Furthermore, it is preferable that these cyclic hydrocarbon groups are directly bonded to an ester bond, from the viewpoint of further enhancing the durable water repellency. The cyclic hydrocarbon group may be alicyclic or aromatic, and in the case of an alicyclic group, the cyclic hydrocarbon group may be a saturated hydrocarbon group or an unsaturated hydrocarbon group. Specific examples of the monomer include isobornyl (meth)acrylate, cyclohexyl (meth)acrylate, and dicyclopentanyl (meth)acrylate. These monomers may be used singly, or two or more kinds thereof may be used in combination. Among them, isobornyl (meth)acrylate and cyclohexyl methacrylate are preferred, and isobornyl methacrylate is more preferred, from the viewpoint that the durable water repellency of the water-repellent textile product thus obtainable can be further enhanced.

The compositional proportion of the monomer of (C2) in the non-fluorinated acrylic polymer is preferably 1% to 30% by mass, more preferably 3% to 25% by mass, and even more preferably 5% to 20% by mass, with respect to the total amount of the monomer components that constitute the non-fluorinated acrylic polymer, from the viewpoints of the water repellency and the texture of the water-repellent textile product thus obtainable.

The monomer of (C3) is a methacrylic acid ester monomer in which an unsubstituted monovalent chain-like hydrocarbon group having 1 to 4 carbon atoms is directly bonded to the ester bond of the ester moiety. Regarding the chain-like hydrocarbon group having 1 to 4 carbon atoms, a linear hydrocarbon group having 1 or 2 carbon atoms and a branched hydrocarbon group having 3 or 4 carbon atoms are preferred. Examples of the chain-like hydrocarbon group having 1 to 4 carbon atoms include a methyl group, an ethyl group, a n-propyl group, an isopropyl group, a n-butyl group, and a t-butyl group. Specific examples of the compound include methyl methacrylate, ethyl methacrylate, n-propyl methacrylate, isopropyl methacrylate, n-butyl methacrylate, isobutyl methacrylate, and t-butyl methacrylate. These monomers may be used singly, or two or more kinds thereof may be used in combination. Among them, methyl methacrylate, isopropyl methacrylate, and t-butyl methacrylate are preferred, and methyl methacrylate is more preferred, from the viewpoint that the durable water repellency of the water-repellent textile product thus obtainable can be further enhanced.

The compositional proportion of the monomer of (C3) in the non-fluorinated acrylic polymer is preferably 1% to 30% by mass, more preferably 3% to 25% by mass, and even more preferably 5% to 20% by mass, with respect to the total amount of the monomer components that constitute the non-fluorinated polymer, from the viewpoints of the water repellency and the texture of the water-repellent textile product thus obtainable.

The monomer of (C4) is a (meth)acrylic acid ester monomer having three or more polymerizable unsaturated groups in one molecule.

In the present embodiment, a polyfunctional (meth) acrylic acid ester monomer having three or more (meth) acryloyloxy groups in one molecule, in which T in General Formula (C-4) described above is a (meth)acryloyloxy group, is preferred. In Formula (C-4), p units of T may be identical or different. Specific examples of the compound include ethoxylated isocyanuric acid triacrylate, tetramethylolmethane tetraacrylate, tetramethylolmethane tetramethacrylate, trimethylolpropane triacrylate, trimethylolpropane trimethacrylate, pentaerythritol triacrylate, pentaerythritol trimethacrylate, dipentaerythritol hexaacrylate, and dipentaerythritol hexamethylacrylate. These monomers may be used singly, or two or more kinds thereof may be used in combination. Among them, tetramethylolmethane tetraacrylate and ethoxylated isocyanuric acid triacrylate are more preferred from the viewpoint that the durable water repellency of the water-repellent textile product thus obtainable can be further enhanced.

The compositional proportion of the monomer of (C4) in the non-fluorinated acrylic polymer is preferably 1% to 30% by mass, more preferably 3% to 25% by mass, and even more preferably 5% to 20% by mass, with respect to the total amount of the monomer components that constitute the non-fluorinated acrylic polymer, from the viewpoints of the water repellency and the texture of the water-repellent textile product thus obtainable.

The monomer of (C5) has a monovalent chain-like saturated hydrocarbon group having 3 to 6 carbon atoms and having a hydroxy group and at least one functional group selected from the group consisting of a chloro group and a bromo group. In regard to the monomer of (C5), $R^{11}$ represents a hydrogen or a methyl group. In view of the durable water repellency of the water-repellent textile product thus obtainable, $R^{11}$ preferably represents a methyl group.

$R^{12}$ represents a monovalent chain-like saturated hydrocarbon group having 3 to 6 carbon atoms and having a hydroxy group and at least one functional group selected from the group consisting of a chloro group and a bromo group. The chain-like saturated hydrocarbon group may be linear or branched. In a case in which the chain-like saturated hydrocarbon group is linear, superior durable water repellency of the water-repellent textile product thus obtainable is obtained. The number of carbon atoms of the chain-like saturated hydrocarbon group is preferably 3 or 4 and more preferably 3, in view of the durable water repellency of the water-repellent textile product thus obtainable.

The chain-like saturated hydrocarbon group preferably has one or two chloro groups and one hydroxy group and more preferably has one chloro group and one hydroxy group, in view of the durable water repellency of the water-repellent textile product thus obtainable. Furthermore, the chain-like saturated hydrocarbon group even more preferably has a hydroxy group at the β-position (a carbon atom adjacent to a carbon atom bonded to $CH_2{=}CR^{11}(CO)O{-}$), in view of the durable water repellency of the water-repellent textile product thus obtainable. Specific examples of the chain-like saturated hydrocarbon group include a 3-chloro-2-hydroxypropyl group, a 3-chloro-2-hydroxybutyl group, a 5-chloro-2-hydroxypentyl group, a 3-chloro-2-hydroxy-2-methylpropyl group, and a 3-bromo-2-hydroxypropyl group.

Specific examples of the monomer of (C5) include 3-chloro-2-hydroxypropyl (meth)acrylate, 3-chloro-2-hydroxybutyl (meth)acrylate, 5-chloro-2-hydroxypentyl (meth)acrylate, and 3-bromo-2-hydroxypropyl (meth)acrylate. Among these, from the viewpoint that the durable water repellency of the water-repellent textile product thus obtainable can be further enhanced, 3-chloro-2-hydroxypropyl (meth)acrylate is preferred and 3-chloro-2-hydroxypropyl methacrylate is more preferred.

The total compositional proportion of the monomers of (C5) in the non-fluorinated acrylic polymer is preferably 1% to 30% by mass, more preferably 3% to 25% by mass, even more preferably 5% to 20% by mass, with respect to the total amount of the monomer components that constitute the non-fluorinated acrylic polymer, from the viewpoint of the durable water repellency of the water-repellent textile product thus obtainable.

The total compositional proportion of the monomers of the component (C) in the non-fluorinated acrylic polymer is preferably 1% to 30% by mass, more preferably 3% to 25% by mass, and even more preferably 5% to 20% by mass, with respect to the total amount of the monomer components that constitute the non-fluorinated acrylic polymer, from the viewpoints of the water repellency and the texture of the water-repellent textile product thus obtainable.

The non-fluorinated acrylic polymer can contain, in addition to the component (A), the component (B), and the component (C), a monofunctional monomer (D) capable of being copolymerized with these components (hereinafter, also referred to as "component (D)"), to the extent that the effects of the present invention are not impaired.

Examples of the monomer of (D) include vinyl-based monomers other than the component (E), which do not contain fluorine, such as (meth)acryloylmorpholine, a (meth)acrylic acid ester having a hydrocarbon group other than the component (A) and the component (C), (meth) acrylic acid, fumaric acid ester, maleic acid ester, fumaric acid, maleic acid, (meth)acrylamide, N-methylolacrylamide, vinyl ethers, vinyl esters, ethylene, and styrene. Incidentally, the (meth)acrylic acid ester having a hydrocarbon group, which is other than the component (A) and the component (C), on the hydrocarbon group, may have a substituent such as a vinyl group, a hydroxy group, an amino group, an epoxy group, and an isocyanate group, blocked isocyanate group, may have a substituent other than a group that can react with a crosslinking agent such as a quaternary ammonium group, and may have an ether bond, an ester bond, an amide bond, a urethane bond, or the like. Examples of the (meth)acrylic acid ester other than the component (A) and the component (C) include methyl acrylate, 2-ethylhexyl (meth)acrylate, benzyl (meth)acrylate, and ethylene glycol di(meth)acrylate.

The compositional proportion of the monomer of the component (D) in the non-fluorinated acrylic polymer is preferably 10% by mass or less with respect to the total amount of the monomer components that constitute the non-fluorinated acrylic polymer, from the viewpoints of the water repellency and the texture of the water-repellent textile product thus obtainable.

It is preferable that the non-fluorinated acrylic polymer has at least one functional group selected from the group consisting of a hydroxy group, an amino group, a carboxy group, an epoxy group, and an isocyanate group, which are all capable of reacting with a crosslinking agent, from the viewpoint of further enhancing the durable water repellency of the water-repellent textile product thus obtainable.

The isocyanate group may form a blocked isocyanate group that is protected with a blocking agent. Furthermore, it is preferable that the non-fluorinated acrylic polymer has an amino group, from the viewpoint of further enhancing the texture of the water-repellent textile product thus obtainable as well.

It is preferable the non-fluorinated acrylic polymer contains at least one monomer (E) from between vinyl chloride and vinylidene chloride (hereinafter, also referred to as "component (E)") as the monomer component in addition to the component (A), from the viewpoint that the water repellency and the peeling strength with respect to a coating of the water-repellent textile product thus obtainable can be further enhanced.

The at least one monomer (E) from between vinyl chloride and vinylidene chloride, which is used for the present embodiment, is preferably vinyl chloride from the viewpoints of the water repellency and the peeling strength with respect to a coating of the water-repellent textile product thus obtainable.

The compositional proportion of the monomer of the component (E) in the non-fluorinated acrylic polymer is preferably 1% to 45% by mass, more preferably 3% to 40% by mass, and even more preferably 5% to 35% by mass, with respect to the total amount of the monomer components that constitute the non-fluorinated acrylic polymer, from the viewpoint that the peeling strength with respect to a coating of the water-repellent textile product thus obtainable can be further enhanced.

A method for producing the non-fluorinated acrylic polymer will be described.

The non-fluorinated acrylic polymer can be produced by a radical polymerization method. Furthermore, from this radical polymerization method, it is preferable that polymerization is carried out by an emulsion polymerization method or a dispersion polymerization method, in view of the performance of the water repellent agent thus obtainable and in an environmental aspect.

For example, a non-fluorinated acrylic polymer can be obtained by subjecting the (meth)acrylic acid ester monomer (A) represented by General Formula (A-1) described above to emulsion polymerization or dispersion polymerization in a medium. More specifically, for example, the component (A), and if necessary, the component (B), the component (C), the component (D), and the component (E), as well as an emulsification aid or a dispersion aid are added to a medium, this mixed liquid is emulsified or dispersed, and thereby, an emulsion or a dispersion is obtained. As a polymerization initiator is added to the emulsion or dispersion thus obtained, a polymerization reaction is initiated, and thus the monomers and the reactive emulsifier can be polymerized. Incidentally, examples of the means for emulsifying or dispersing the mixed liquid include a homomixer, a high pressure emulsifying machine, or an ultrasonicator.

Regarding the emulsification aid or dispersion aid (hereinafter, also referred to as "emulsification aid or the like"), one or more selected from a nonionic surfactant, a cationic surfactant, an anionic surfactant, and an amphoteric surfactant, all other than the reactive emulsifier (B), can be used. The content of the emulsification aid or the like is preferably 0.5 to 30 parts by mass, more preferably 1 to 20 parts by mass, and even more preferably 1 to 10 parts by mass, with respect to 100 parts by mass of all the monomers. If the content of the emulsification aid or the like is 0.5 parts by mass or more, the dispersion stability of the mixed liquid tends to be further enhanced. If the content of the emulsification aid or the like is 30 parts by mass or less, the water repellency of the water repellent agent composition thus obtainable tends to be further enhanced.

The medium for the emulsion polymerization or dispersion polymerization is preferably water, and if necessary, water may be mixed with an organic solvent. Examples of the organic solvent used at this time include alcohols such as methanol and ethanol; esters such as ethyl acetate; ketones such as acetone and methyl ethyl ketone; ethers such as diethyl ether; and glycols such as propylene glycol, dipropylene glycol, and tripropylene glycol. Incidentally, the ratio of water and the organic solvent is not particularly limited.

Regarding the polymerization initiator, known polymerization initiators such as azo-based, peroxide-based, or redox-based polymerization initiators can be used as appropriate. The content of the polymerization initiator is preferably 0.01 to 2 parts by mass with respect to 100 parts by mass of all the monomers. When the content of the polymerization initiator is in the range described above, a non-fluorinated acrylic polymer having a weight average molecular weight of 100,000 or more can be produced efficiently.

Furthermore, a chain transfer agent such as dodecylmercaptan or t-butyl alcohol may also be used in the polymerization reaction for the purpose of adjusting the molecular weight.

Incidentally, a polymerization inhibitor may also be used for the adjustment of the molecular weight. A non-fluorinated acrylic polymer having a desired weight average molecular weight can be easily obtained by adding a polymerization inhibitor.

The temperature of the polymerization reaction is preferably 20° C. to 150° C. If the temperature is 20° C. or higher, polymerization tends to be likely to proceed sufficiently, and if the temperature is 150° C. or lower, control of the reaction heat is likely to become easy.

In regard to the polymerization reaction, the weight average molecular weight of the non-fluorinated acrylic polymer thus obtainable can be adjusted by increasing or decreasing the content of the polymerization initiator, chain transfer agent, and polymerization inhibitor mentioned above, and the melt viscosity at 105° C. can be adjusted by increasing or decreasing the content of the polyfunctional monomer and the content of the polymerization initiator. Incidentally, in a case in which the melt viscosity at 105° C. is desired to be decreased, the content of a monomer having two or more polymerizable functional groups may be decreased, or the content of the polymerization initiator may be increased.

The content of the non-fluorinated acrylic polymer in the polymer emulsion liquid or dispersion liquid obtainable by emulsion polymerization or dispersion polymerization is preferably adjusted to 10% to 50% by mass and more preferably to 20% to 40% by mass, with respect to the total amount of the emulsion liquid or dispersion liquid, from the viewpoints of the storage stability and the handleability of the composition.

Examples of the hydrocarbon group-containing compound include NEOSEED NR-90 (manufactured by NICCA CHEMICAL CO., LTD.), NR-158 (manufactured by NICCA CHEMICAL CO., LTD.), TH-44 (manufactured by NICCA CHEMICAL CO., LTD.), PW-182 (manufactured by DAIWA CHEMICAL INDUSTRIES CO., LTD.), PHOBOTEX RSH (manufactured by Huntsman Japan KK), PARAGIUM ECO-500 (manufactured by Ohara Paragium Chemical Co., Ltd.), and NX018 (manufactured by NANOTEX CORPORATION).

<Other Components>

The water repellent agent composition of the present embodiment may further contain, in addition to the respective components described above, a polyfunctional isocyanate compound, a surfactant, an antifoaming agent, an organic acid, an inorganic acid, an alcohol, an antibacterial agent, an antifungal agent, a pH adjuster, a colorant, silica, an antioxidant, a refresher, various catalysts, an emulsion stabilizer, various solvents, a chelating agent, an antistatic agent, organo-modified silicone, a crosslinking agent other than the polyfunctional isocyanate compound, or the like.

The polyfunctional isocyanate compound is not particularly limited as long as it is a compound has two or more isocyanate groups in the molecule, and conventionally known polyisocyanate compounds can be used. Examples of the polyfunctional isocyanate compound include diisocyanate compounds such as alkylene diisocyanate, aryl diisocyanate, and cycloalkyl diisocyanate, and modified polyisocyanate compounds such as dimers, trimers, or tetramers of those diisocyanate compounds. The number of carbon atoms of alkylene diisocyanate is preferably 1 to 12.

Examples of the diisocyanate compound include 2,4- or 2,6-tolylene diisocyanate, ethylene diisocyanate, propylene diisocyanate, 4,4-diphenylmethane diisocyanate, p-phenylene diisocyanate, tetramethylene diisocyanate, hexamethylene diisocyanate, decamethylene diisocyanate, dodecamethylene diisocyanate, 2,4,4-trimethyl hexamethylene-1,6-diisocyanate, phenylene diisocyanate, tolylene or naphthylene diisocyanate, 4,4'-methylene-bis(phenylisocyanate), 2,4'-methylene-bis(phenylisocyanate), 3,4'-methylene-bis(phenylisocyanate), 4,4'-ethylene-bis(phenylisocyanate), ω,ω'-diisocyanate-1,3-dimethyl benzene, ω,ω'-diisocyanate-1,4-dimethyl cyclohexane, ω,ω'-diisocyanate-1,4-dimethyl benzene, ω,ω'-diisocyanate-1,3-dimethyl cyclohexane, 1-methyl-2,4-diisocyanate cyclohexane, 4,4'-methylene-bis(cyclohexyl isocyanate), 3-isocyanate-methyl-3,5,5-trimethylcyclohexylisocyanate, acid-diisocyanate dimer, ω,ω'-diisocyanate diethylbenzene, ω,ω'-diisocyanate dimethyl toluene, ω,ω'-diisocyanate diethyl toluene, fumaric acid bis(2-isocyanateethyl)ester, 1,4-bis(2-isocyanate-prop-2-yl)benzene, and 1,3-bis(2-isocyanate-prop-2-yl)benzene.

Examples of the triisocyanate compound include triphenylmethane triisocyanate and tris(isocyanatophenyl)-thiophosphate. Examples of the tetraisocyanate compound include dimethyltriphenylmethane tetraisocyanate.

The modified polyisocyanate compound derived from a diisocyanate compound is not particularly limited as long as it has two or more isocyanate groups, and examples include a polyisocyanate having a biuret structure, an isocyanurate structure, a urethane structure, a urethodione structure, an allophanate structure, or a trimer structure, and an adduct of an aliphatic isocyanate with trimethylolpropane.

Furthermore, polymeric MDI (IMDI=diphenylmethane diisocyanate) can also be used as the polyisocyanate compound. Regarding the polyisocyanate compound, one kind can be used alone, or two or more kinds thereof can be used in combination.

The isocyanate group of the polyfunctional isocyanate compound may be used without any change, or may be a blocked isocyanate group blocked with a blocking agent. Examples of the blocking agent include pyrazoles such as 3,5-dimethylpyrazole, 3-methylpyrazole, 3,5-dimethyl-4-nitropyrazole, 3,5-dimethyl-4-bromopyrazole, and pyrazole; phenols such as phenol, methylphenol, chlorophenol, isobutylphenol, tert-butylphenol, iso-amylphenol, octylphenol, and nonylphenol; lactams such as ε-caprolactam, δ-valerolactam, and γ-butryolactam; active methylene compounds such as dimethyl malonate, diethyl malonate, acetyl acetone, methyl acetoacetate, and ethyl acetoacetate; oximes such as formaldoxime, acetaldoxime, acetone oxime, methyl ethyl ketone oxime, cyclohexanone oxime, acetophenone oxime, and benzophenone oxime; imidazole compounds such as imidazole, 2-methyl imidazole; and sodium bisulfite. Among these, from the viewpoint of durable water repellency, pyrazoles and oximes are preferred.

As the polyfunctional isocyanate compound, water-dispersible isocyanate in which water dispersibility is imparted to polyisocyanate by introducing a hydrophilic group to a polyisocyanate structure to have surface active effect can also be used. Furthermore, in order to promote reaction between an amino group and an isocyanate group, conventionally known catalysts such as organic tin and organic zinc can also be used concurrently.

The amount of the polyfunctional isocyanate compound mixed in the water repellent agent composition of the present embodiment is preferably 1 to 200 parts by mass and more preferably 5 to 100 parts by mass, with respect to 100 parts by mass of the total of the amount of the compound (1) mixed and the amount of the silicone resin mixed, from the viewpoints of water repellency, durable water repellency, and texture.

In a case in which the water repellent agent composition of the present embodiment contains, as a water repellent component, a component other than the compound (1) and the component (I), the amount of the polyfunctional isocyanate compound mixed is preferably 1 to 200 parts by mass and more preferably 5 to 100 parts by mass, with respect to 100 parts by mass of the total amount of the water repellent component, from the viewpoints of water repellency, durable water repellency, and texture. In this case, the total amount of the compound (1) and the component (I) mixed in the water repellent component is preferably 1% by mass or more and more preferably 10% to 90% by mass, on the basis of the total amount of the water repellent component.

The surfactant essentially contains a polyalkylene oxide adduct and may further include other surfactants. Regarding the other surfactants, for example, surfactants having roles of expanding a temperature range in which the emulsion state is stably maintained and adjusting the amount of foam generated in a case in which a diluted solution is prepared by mixing the surfactant with water may be used. The other surfactants may include any of a non-ionic surfactant, an anionic surfactant, a cationic surfactant, and an amphoteric surfactant. Regarding the other surfactants, one kind can be used alone, or two or more kinds thereof can be used in combination.

Examples of the antifoaming agent include, although not particularly limited, fat and oil-based antifoaming agents such as castor oil, sesame oil, linseed oil, and animal or vegetable oil; fatty acid-based antifoaming agents such as stearic acid, oleic acid, and palmitic acid; fatty acid ester-based antifoaming agents such as isoamyl stearate, distearyl succinate, ethylene glycol distearate, and butyl stearate; alcohol-based antifoaming agents such as polyoxyalkylene monohydric alcohol, di-t-amylphenoxyethanol, 3-heptanol, and 2-ethylhexanol; ether-based antifoaming agents such as di-t-amylphenoxyethanol, 3-heptylcellosolve, nonylcellosolve, and 3-heptylcarbitol; phosphoric acid ester-based antifoaming agents such as tributyl phosphate and tris(butoxyethyl) phosphate; amine-based antifoaming agents other than the compound (1) such as diamylamine; amide-based antifoaming agents such as polyalkylene amide and acylated polyamine; sulfuric acid ester-based antifoaming agents such as sodium lauryl sulfate; and mineral oil. Regarding the antifoaming agent, one kind can be used alone, or two or more kinds thereof can be used in combination.

Examples of the organic acid include, although not particularly limited, lactic acid, acetic acid, propionic acid, maleic acid, oxalic acid, formic acid, methanesulfonic acid, and toluenesulfonic acid. Regarding the organic acid, one kind can be used alone, or two or more kinds thereof can be used in combination.

Examples of the inorganic acid include, although not particularly limited, hydrogen chloride, sulfuric acid, and nitric acid. Regarding the inorganic acid, one kind can be used alone, or two or more kinds thereof can be used in combination.

Examples of the alcohol include, although not particularly limited, ethanol, isopropanol, glycerin, trimethylolpropane, diethylene glycol, triethylene glycol, dipropylene glycol, and propylene glycol. Regarding the alcohol, one kind can be used alone, or two or more kinds thereof can be used in combination.

As the antistatic agent, an antistatic agent that hardly inhibits water repellency performance may be used. Examples of the antistatic agent include cationic surfactants such as a higher alcohol sulfate ester salt, sulfated oil, a sulfonic acid salt, a quaternary ammonium salt, and an imidazoline type quaternary salt; non-ionic surfactants such as polyethylene glycol type and polyhydric alcohol ester type surfactants; amphoteric surfactants such as an imidazoline type quaternary salt, an alanine type surfactant, and a betaine type surfactant; and polymeric compound types such as polyalkylamine. Regarding the antistatic agent, one kind can be used alone, or two or more kinds thereof can be used in combination.

Examples of the crosslinking agent other than the polyfunctional isocyanate compound may include a melamine resin and a glyoxal resin.

As the melamine resin, a compound having a melamine skeleton can be used, and examples include polymethylol melamines such as trimethylol melamine and hexamethylol melamine; alkoxymethyl melamine in which a part or the whole of a methylol group of polymethylol melamine is substituted with an alkoxymethyl group having an alkyl group having 1 to 6 carbon atoms; and acyloxymethyl melamine in which a part or the whole of a methylol group of polymethylol melamine is substituted with an acyloxymethyl group having an acyl group having 2 to 6 carbon atoms. These melamine resins may be a monomer or a polymer of a dimer or more, or a mixture thereof may be used. Furthermore, those in which a part of melamine is co-condensated with urea or the like can be used. Examples of such a melamine resin include "BECKAMINE APM", "BECKAMINE M-3", "BECKAMINE M-3(60)", "BECKAMINE MA-S", "BECKAMINE J-101", and "BECKAMINE J-101LF" manufactured by DIC Corporation, "UNIKA RESIN 380K" manufactured by Union Chemical Industry Co., Ltd., and "Riken Resin MM series" manufactured by Miki Riken Industrial Co., Ltd.

As the glyoxal resin, conventionally known glyoxal resins can be used. Examples of the glyoxal resin include a 1,3-dimethylglyoxal urea-based resin, a dimethylol dihydroxyethylene urea-based resin, and a dimethylol dihydroxypropylene urea-based resin. The functional groups of those resins may be substituted with other functional groups. Examples of such a glyoxal resin include "BECKAMINE N-80", "BECKAMINE NS-11", "BECKAMIINE LF-K", "BECKAMINE NS-19", "BECKAMINE LF-55P Conc.", "BECKAMINE NS-210L", "BECKAMINE NS-200", and "BECKAMINE NF-3" manufactured by DIC Corporation, "UNI RESIN GS-20E" manufactured by Union Chemical Industry Co., Ltd., and "Riken Resin RG series" and "Riken Resin MS series" manufactured by Miki Riken Industrial Co., Ltd.

It is preferable to use a catalyst in the melamine resin and the glyoxal resin, from the viewpoint of promoting reaction. Such a catalyst is not particularly limited as long as it is a catalyst generally used, and examples include fluoroborate compounds such as ammonium fluoroborate and zinc fluoroborate; neutral metal salt catalysts such as magnesium chloride and magnesium sulfate; and inorganic acids such as phosphoric acid, hydrochloric acid, and boric acid. In regard to these catalysts, if necessary, organic acids such as citric acid, tartaric acid, malic acid, maleic acid, and lactic acid can also be concurrently used as a promoter. Examples of such a catalyst include "CATALYST ACX", "CATALYST 376", "CATALYST O", "CATALYST M", "CATALYST G (GT)", "CATALYST X-110", "CATALYST GT-3", and "CATALYST NFC-1" manufactured by DIC Corporation, "UNIKA CATALYST 3-P" and "UNIKA CATALYST MC-109" manufactured by Union Chemical Industry Co., Ltd., and "Riken Fixer RC series", "Riken Fixer MX series", and "Riken Fixer RZ-5" manufactured by Miki Riken Industrial Co., Ltd.

The water repellent agent composition according to the present embodiment can be suitably used for use applications such as a textile product processing agent, a paper product processing agent, and a leather product processing agent.

A method for producing a water repellent agent composition of the present embodiment will be described.

The water repellent agent composition of the present embodiment can be obtained by mixing the compound (1) represented by General Formula described above and the silicone resin which are described above. The content of each component in the water repellent agent composition of the present embodiment can be set to the preferable mixed amount described above.

The water repellent agent composition of the present embodiment may be a one-agent type obtained by mixing the compound represented by General Formula (1) described above and the silicone resin in advance and may be a two-agent type in which the above-described two components are separated from each other. In regard to the water repellent agent composition of the present embodiment, it is preferable that the two components are dispersed (including, emulsified and dissolved) in an aqueous medium, from the viewpoint of ease of handling.

In a case in which the water repellent agent composition is a one-agent type obtained by mixing the compound (1) and the component (I) in advance, the water repellent agent composition of the present embodiment can be obtained by simultaneously dispersing (including, emulsifying and dissolving) the compound (1) and the component (I) in an aqueous medium, by mixing a dispersion liquid, which is obtained by dispersing the compound (1) in an aqueous medium, and a dispersion liquid, which is obtained by dispersing the component (I) in an aqueous medium, or by mixing the other compound or component with one of these dispersion liquids.

As the method of dispersing the respective components in an aqueous medium, for example, a method of mixing and stirring the respective components, an aqueous medium, and as necessary, a dispersant is exemplified. In the case of mixing and stirring, conventionally known emulsifying dispersers such as Milder, a high-speed stirrer, a homogenizer, an ultrasonic homogenizer, a homomixer, a bead mill, a pearl mill, Dyno Mill, an aspek mill, a basket mill, a ball mill, a nanomizer, an artimizer, and Star Burst may be used. Regarding these emulsifying dispersers, one kind may be used alone, or two or more kinds thereof can be used in combination.

The aqueous medium is preferably water or a mixed solvent of water and a hydrophilic solvent that is miscible in water. Examples of the hydrophilic solvent include methanol, ethanol, isopropyl alcohol, ethylene glycol, diethylene glycol, hexylene glycol, glycerin, butyl glycol, butyl diglycol, SOLFIT, N-methylpyrrolidone, dimethylformamide, and dimethylsulfoxide.

It is preferable that the dispersion liquid further contains a surfactant, from the viewpoint of dispersion stability. Such a surfactant is not particularly limited as long as it can enhance emulsion dispersion stability, and examples include conventionally known non-ionic surfactants, anionic surfactants, cationic surfactants, and amphoteric surfactants. Regarding these surfactants, one kind can be used alone, or two or more kinds thereof can be used in combination.

The dispersion liquid may be used as a treatment liquid without any changes, and can also be used as a treatment liquid by being diluted with an aqueous medium or a hydrophobic organic solvent. The dispersion liquid may be used in a state of being unneutralized (being not neutralized) and may be used after the pH adjustment is performed by a method such as neutralization of the compound (1) by a pH adjuster. In the case of performing the pH adjustment, the pH of the treatment liquid can be adjusted to be 5.5 to 6.5.

In pH adjustment, for example, organic acids such as lactic acid, acetic acid, propionic acid, maleic acid, oxalic acid, formic acid, methanesulfonic acid, and toluenesulfonic acid; inorganic acids such as hydrogen chloride, sulfuric acid, and nitric acid; hydroxides such as sodium hydroxide and potassium hydroxide; carbonates such as sodium carbonate, sodium hydrogen carbonate, potassium carbonate, and sodium sesquicarbonate; organic amines such as monoethanolamine, diethanolamine, triethanolamine, and triethylamine; ammonia; and the like can be used.

A method for producing a water-repellent textile product of the present embodiment will be described.

The method of the present embodiment includes a step of treating fibers with a treatment liquid including the water repellent agent composition of the present embodiment. Through this step, a water-repellent textile product is obtainable.

The material of the fibers is not particularly limited, and examples include natural fibers such as cotton, linen, silk, and sheep wool; semi-synthetic fibers such as rayon and acetate; synthetic fibers such as nylon, polyester, polyurethane, and polypropylene; composite fibers thereof; and blend fibers. The form of fibers may be any form of thread, fabric, non-woven fabric, paper, and the like. The fibers may be a textile product.

Examples of the method of treating fibers with a treatment liquid including the water repellent agent composition of the present embodiment include a method of performing treatment by one step using a treatment liquid including the compound (1) and the component (I) and a method of performing treatment by two steps using a treatment liquid including one of the above-described two components and a treatment liquid including the other one. In the case of treating fibers by two steps, the order of treatment using respective components may be any order.

The method of treating fibers with the treatment liquid is sufficient to be a method of bringing the treatment liquid into contact with fibers, and examples thereof include processing methods such as immersion, spraying, and coating. Furthermore, in a case in which the water repellent agent composition contains water, it is preferable that the water repellent agent composition is attached to the fibers, and then the fibers are dried in order to remove water.

The amount of attachment of the water repellent agent composition of the present embodiment to fibers can be appropriately adjusted according to the degree of water repellency required; however, the amount of attachment of the water repellent agent composition is adjusted to be preferably 0.1 to 20 g and more preferably 0.1 to 5 g with respect to 100 g of fibers. When the amount of attachment of the water repellent agent composition is 0.1 g or more, there is a tendency that the fibers easily exhibit sufficient water repellency. When the amount of attachment of the water repellent agent composition is 20 g or less, the texture of the fibers tends to be further enhanced and economic advantage tends to be obtainable.

Furthermore, after the water repellent agent composition of the present embodiment is attached to the fibers, it is preferable that the fibers are heat-treated as appropriate. There are no particular limitations on the temperature conditions; however, it is preferable to perform the heat treatment at 110° C. to 180° C. for 1 to 5 minutes, from the viewpoints of water repellency, durable water repellency, texture, and peeling strength.

The water-repellent textile product of the present embodiment has excellent water repellency and flexible texture, and thus is suitably used for fiber use applications of clothing, non-clothing, and the like such as side fabric for down, coats, blousons, windbreakers, blouses, dress shirts, skirts, slacks, gloves, hats, mattress sheets, mattress covers, curtains, or tents.

EXAMPLES

Hereinafter, the present invention will be described in more detail by way of Examples; however, the present invention is not intended to be limited by these Examples.

Preparation of Dispersion Liquid

Example 1

10 parts by mass of MQ-1600 (trimethylsilyl group-containing polysiloxane, manufactured by Dow Corning Toray Co., Ltd., trade name) as the silicone resin was added to 10 parts by mass of MORESCO-WHITE P-40 (low-viscosity hydrocarbon, manufactured by MORESCO Corporation, trade name) and 10 parts by mass of DOW CORNING TORAY SH 200 FLUID 100cs (low-viscosity methylpolysiloxane, manufactured by Dow Corning Toray Co., Ltd., trade name) as the solvents and mixed until the silicone resin was dissolved, thereby obtaining a mixture. Subsequently, after it was confirmed that the mixture was uniform, 0.14 parts by mass of laurylamine as the compound (1) was added to the mixture, and the mixture was heated to dissolve the laurylamine. The mixed liquid after heating was cooled to room temperature. Subsequently, 0.75 parts by mass of SOFTANOL 50 (5-mol ethylene oxide adduct of branched alcohol having 12 to 14 carbon atoms, manufactured by NIPPON SHOKUBAI CO., LTD., trade name) and 0.75 parts by mass of SOFTANOL 90 (9-mol ethylene oxide adduct of branched alcohol having 12 to 14 carbon atoms, manufactured by NIPPON SHOKUBAI CO., LTD., trade name) as the non-ionic surfactants were mixed with the cooled mixture. Subsequently, 68.4 parts by mass of water as the aqueous medium was added to the mixture little by little, thereby obtaining a dispersion liquid.

Examples 2 to 16 and 19 to 21

Dispersion liquids were obtained in the similar manner to Example 1, except that compositions were changed to compositions (unit: parts by mass) presented in Tables 1 to 3. In the tables, the melting point (mp) or the freezing point (fp) of the compound (1) was presented.

Example 17

Into a 500 mL pressure-resistant flask, 30 g of stearyl acrylate, 10 g of lauryl acrylate, 20 g of chloroethylene, 5 g of 30-mol ethylene oxide adduct of 3-styrenated phenol, 3 g of ARQUAD T-28 (manufactured by Lion Corporation, trade name, stearyl trimethyl ammonium chloride), 25 g of tripropylene glycol, and 206.7 g of water were put, and mixed and stirred at 45° C. to obtain a mixed liquid. This mixed liquid was irradiated with ultrasonic waves to disperse the whole monomer by emulsification. Subsequently, 0.3 g of azobis(isobutylamidine) dihydrochloride was added to the mixed liquid and subjected to radical polymerization at 60° C. for 6 hours in a nitrogen atmosphere, thereby obtaining a non-fluorinated acrylic polymer dispersion liquid containing 20% by mass of a non-fluorinated acrylic polymer. Subsequently, 50 parts by mass of the obtained non-fluorinated acrylic polymer dispersion liquid containing 20% by mass of the non-fluorinated acrylic polymer was mixed with 50 parts by mass of the dispersion liquid obtained in Example 6, thereby obtaining a dispersion liquid.

Example 18

10 parts by mass of MORESCO-WHITE P-40 and 10 parts by mass of DOW CORNING TORAY SH 200 FLUID 100cs were used as the solvent, 10 parts by mass of MQ-1600 as the silicone resin was added to the solvent and mixed until the silicone resin was dissolved, thereby obtaining a mixture. Subsequently, after it was confirmed that the mixture was uniform, 0.2 parts by mass of oleylamine as the compound (1) was added to the mixture, and the mixture was heated to dissolve the oleylamine. Subsequently, the mixed liquid after heating was cooled to room temperature. Subsequently, 0.1 parts by mass of SF8417 as the amino-modified silicone was added to the cooled mixture and mixed. Thereafter, 0.75 parts by mass of SOFTANOL 50 and 0.75 parts by mass of SOFTANOL 90 as the non-ionic surfactants were added to the mixture and mixed. Subsequently, 68.2 parts by mass of water as the aqueous medium was added to the mixture little by little, thereby obtaining a dispersion liquid.

Comparative Example 1

A dispersion liquid was obtained in the similar manner to Example 6, except that the silicone resin was not added, and the amounts of MORESCO-WHITE P-40 and DOW CORNING TORAY SH 200 FLUID 100cs mixed were set to 15 parts by mass, respectively.

Comparative Example 2

The non-fluorinated acrylic polymer dispersion liquid containing 20% by mass of the non-fluorinated acrylic polymer obtained in Example 17 was used as the dispersion liquid without any changes.

Comparative Example 3

A dispersion liquid was obtained in the similar manner to Example 18, except that the compound (1) and MORESCO-WHITE P-40 were not added and the amounts of SF8417, DOW CORNING TORAY SH 200 FLUID 100cs, and water mixed were set to 2 parts by mass, 20 parts by mass, and 66.5 parts by mass, respectively.

Comparative Example 4

A dispersion liquid was obtained in the similar manner to Example 1, except that the compound (1) was not added and the amount of water mixed was set to 68.5 parts by mass.

Comparative Example 5

0.75 parts by mass of SOFTANOL 50 and 0.75 parts by mass of SOFTANOL 90 as the non-ionic surfactants were mixed with 30 parts by mass of SF8417 as the amino-modified silicone, thereby obtaining a mixture. Subsequently, 68.5 parts by mass of water was added to the mixture little by little, thereby obtaining a dispersion liquid.

(Water Repellency Evaluation of Water-Repellent Textile Product)

A test was performed according to the spray method of JIS L 1092 (2009) at a shower water temperature of 20° C. In the present test, a 100% polyester fabric or 100% nylon fabric which had been dyed was subjected to an immersion treatment (pickup rate: 60% by mass) in a treatment liquid obtained by diluting each of the dispersion liquids obtained in Examples and Comparative Examples with water such that the content of the dispersion liquid would be 3% by mass, and then the fabric was dried at 130° C. for 1 minute. Further, in the 100% polyester fabric, the fabric was heat-treated at 180° C. for 30 seconds, and in the 100% nylon fabric, the fabric was heat-treated at 170° C. for 30 seconds, thereby obtaining a water-repellent textile product. The water repellency of the water-repellent textile product thus obtained was evaluated. The results were evaluated by the following criteria by visual inspection. Incidentally, a case in which the property was between Grade 4 and Grade 5 was designated as "4-5". The results are presented in Tables 1 to 4.

Water Repellency: State

5: There is no moisture adhering to the surface.
4: There is slight moisture adhering to the surface.
3: The surface shows partial wetting.
2: The surface shows wetting.
1: The entire surface shows wetting.
0: Both the front surface and the back surface show complete wetting.

(Durable Water Repellency Evaluation of Water-Repellent Textile Product) A test was performed according to the spray method of JIS L 1092 (2009) at a shower water temperature of 20° C. In the present test, a 100% polyester fabric or 100% nylon fabric, which had been dyed, was subjected to an immersion treatment (pickup rate: 60% by mass) in a treatment liquid obtained by diluting each of the dispersion liquids of Examples and Comparative Examples and each of the above-described chemical agents with water such that each of the dispersion liquids obtained in each of Examples and Comparative Examples would be 3% by mass, NK ASSIST NY-50 (manufactured by NICCA CHEMICAL CO., LTD., trade name) as the blocked isocyanate-based crosslinking agent would be 1% by mass, TEXPORT BG-290 (manufactured by NICCA CHEMICAL CO., LTD., trade name) as the penetrant would be 1% by mass, and NICEPOLE FE-26 (manufactured by NICCA CHEMICAL CO., LTD., trade name) as the antistatic agent would be 0.5% by mass, and then the fabric was dried at 130° C. for 1 minute. Further, in the 100% polyester fabric, the fabric was heat-treated at 180° C. for 30 seconds, in the 100% nylon fabric, the fabric was heat-treated at 170° C. for 30 seconds, the obtained fabric was washed by the 103 method of JIS L 0217 (1995) 10 times (L-10), and the water repellency after air drying was evaluated in the similar manner to the water repellency evaluation method described above. The results are presented in Tables 1 to 4.

(Texture Evaluation of Water-Repellent Textile Product)

The texture of the water-repellent textile product obtained in the water repellency evaluation of the water-repellent textile product was evaluated on the basis of handling. The texture was evaluated by the following five grades. The results are presented in Tables 1 to 4.

1: Hard ~ 5: Soft (Evaluation of Peeling Strength with Respect to Water-Repellent Textile Product)

A test was performed according to JIS K 6404-5 (1999). First, each of the dispersion liquids obtained in Examples and Comparative Examples was diluted with water such that the dispersion liquid would be 3% by mass and NK ASSIST NY-50 (manufactured by NICCA CHEMICAL CO., LTD.) as the crosslinking agent would be 1% by mass, thereby preparing a treatment liquid. Subsequently, the dyed 100% nylon fabric was subjected to an immersion treatment (pickup rate: 60% by mass) using the obtained treatment liquid. Subsequently, the fabric subjected to the immersion treatment was dried at 130° C. for 2 minutes and further heat-treated at 160° C. for 30 seconds, thereby obtaining a base fabric. A seam tape ("MELCO tape" manufactured by SAN CHEMICALS, LTD.) was thermally adhered to the base fabric thus obtained at 150° C. for 1 minute using a thermocompression bonding apparatus, and the interlayer peeling strength between the base fabric and the seam tape was measured with an autograph (AG-IS, manufactured by SHIMADZU CORPORATION). The base fabric and the tape were pulled at a movement speed of the clamping jaws of 100 mm/min, and the average value of stress was designated as the peeling strength [N/inch]. The results are presented in Tables 1 to 4.

(Seam Slippage Property Evaluation of Water-Repellent Textile Product)

The seam slippage resistance of the water-repellent textile product obtained in the water repellency evaluation of the water-repellent textile product was measured by 8.23 Slippage Resistance 8.23.1 Seam Slippage Method b) B Method of JIS L 1096:2010. A smaller numerical value indicates that the water-repellent textile product is excellent in seam slippage property. In particular, the case of 4 mm or less was evaluated to be favorable. The results are presented in Tables 1 to 4.

TABLE 1

| | | Example 1 | Example 2 | Example 3 | Example 4 | Example 5 | Example 6 | Example 7 | Example 8 |
|---|---|---|---|---|---|---|---|---|---|
| Compound (1) | Laurylamine (mp: 28° C.) | 0.14 | — | — | — | — | — | — | — |
| | Stearylamine (mp: 53° C.) | — | 0.05 | 0.1 | 0.2 | 0.3 | 0.5 | 1 | 2 |
| | Cetylamine (fp: 47° C.) | — | — | — | — | — | — | — | — |
| | Oleylamine (fp: 15° C.) | — | — | — | — | — | — | — | — |
| | Behenylamine (fp: 55° C to 65° C.) | — | — | — | — | — | — | — | — |
| | 3-(Stearylamino)propylamine (mp: 30° C. to 40° C.) | — | — | — | — | — | — | — | — |
| | Distearylamine (mp: 60° C. to 70° C.) | — | — | — | — | — | — | — | — |
| Silicone resin | MQ-1600 | 10 | 10 | 10 | 10 | 10 | 10 | 10 | 10 |
| Amino-modified silicone | SF8417 | — | — | — | — | — | — | — | — |
| Solvent | MORESCO-WHITE P-40 | 10 | 10 | 10 | 10 | 10 | 10 | 10 | 10 |
| | DOW CORNING TORAY SH 200 FLUID 100 cs | 10 | 10 | 10 | 10 | 10 | 10 | 10 | 10 |
| Non-ionic surfactant | SOFTANOL 50 | 0.75 | 0.75 | 0.75 | 0.75 | 0.75 | 0.75 | 0.75 | 0.7 |
| | SOFTANOL 90 | 0.75 | 0.75 | 0.75 | 0.75 | 0.75 | 0.75 | 0.75 | 0.7 |
| Non-fluorinated acrylic polymer | | — | — | — | — | — | — | — | — |
| Aqueous medium | Water | 68.4 | 68.5 | 68.4 | 68.3 | 68.2 | 68.0 | 67.5 | 66.5 |
| Water repellency (polyester) | Washing 0 times (L-0) | 4-5 | 4-5 | 5 | 5 | 5 | 5 | 4-5 | 4 |
| Durable water repellency (polyester) | Washing 10 times (L-10) | 3-4 | 3 | 4-5 | 4-5 | 4-5 | 4-5 | 3-4 | 3 |
| Water repellency (nylon) | Washing 0 time (L-0) | 4 | 4-5 | 5 | 5 | 5 | 5 | 4-5 | 3-4 |
| Durable water repellency (nylon) | Washing 10 times (L-10) | 2-3 | 2-3 | 2-3 | 2-3 | 3 | 3 | 2-3 | 2-3 |
| Texture (polyester) | | 4 | 4 | 4 | 4 | 4 | 4 | 4 | 4 |
| Peeling strength (nylon) (N/inch) | | 12.7 | 10.2 | 11.1 | 11.2 | 12.1 | 11.5 | 11.2 | 11.2 |
| Seam slippage property (nylon) (mm) | | 2.2 | 2.2 | 2.3 | 2.3 | 2.4 | 2.3 | 2.4 | 2.3 |

TABLE 2

| | | Example 9 | Example 10 | Example 11 | Example 12 | Example 13 | Example 14 | Example 15 | Example 16 |
|---|---|---|---|---|---|---|---|---|---|
| Compound (1) | Laurylamine (mp: 28° C.) | — | — | — | — | — | — | — | — |
| | Stearylamine (mp: 53° C.) | — | — | — | — | — | 0.5 | 0.5 | 0.6 |
| | Cetylamine (fp: 47° C.) | 0.09 | — | — | — | — | — | — | — |
| | Oleylamine (fp: 15° C.) | — | 0.2 | — | — | — | — | — | — |
| | Behenylamine (fp: 55° C to 65° C.) | — | — | 0.24 | — | — | — | — | — |
| | 3-(Stearylamino)propylamine (mp: 30° C. to 40° C.) | — | — | — | 0.1 | — | — | — | — |
| | Distearylamine (mp: 60° C. to 70° C.) | — | — | — | — | 0.4 | — | — | — |
| Silicone resin | MQ-1600 | 10 | 10 | 10 | 10 | 10 | 10 | 10 | 6 |
| Amino-modified silicone | SF8417 | — | — | — | — | — | — | — | — |
| Solvent | MORESCO-WHITE P-40 | 10 | 10 | 10 | 10 | 10 | 20 | — | 12 |
| | DOW CORNING TORAY SH 200 FLUID 100 cs | 10 | 10 | 10 | 10 | 10 | — | 20 | 12 |
| Non-ionic surfactant | SOFTANOL 50 | 0.75 | 0.75 | 0.75 | 0.75 | 0.75 | 0.75 | 0.75 | 0.7 |
| | SOFTANOL 90 | 0.75 | 0.75 | 0.75 | 0.75 | 0.75 | 0.75 | 0.75 | 0.7 |
| Non-fluorinated acrylic polymer | | — | — | — | — | — | — | — | — |
| Aqueous medium | Water | 68.4 | 68.3 | 68.3 | 68.4 | 68.1 | 68.0 | 68.0 | 68.0 |
| Water repellency (polyester) | Washing 0 times (L-0) | 4-5 | 3-4 | 4-5 | 4-5 | 3-4 | 5 | 5 | 5 |
| Durable water repellency (polyester) | Washing 10 times (L-10) | 3 | 3 | 3 | 3 | 3 | 4-5 | 4-5 | 4 -5 |
| Water repellency (nylon) | Washing 0 time (L-0) | 4-5 | 5 | 5 | 5 | 5 | 5 | 5 | 5 |
| Durable water repellency (nylon) | Washing 10 times (L-10) | 2-3 | 2-3 | 2-3 | 2-3 | 2-3 | 3 | 3 | 3 |
| Texture (polyester) | | 4 | 4 | 4 | 4 | 4 | 4 | 3-4 | 4 |
| Peeling strength (nylon) (N/inch) | | 11.1 | 1.1 | 10.9 | 10.8 | 10.9 | 11.6 | 11.4 | 11.3 |
| Seam slippage property (nylon) (mm) | | 2.3 | 2.1 | 2.4 | 2.3 | 2.3 | 2.3 | 2.3 | 2.3 |

TABLE 3

| | | Example 17 | Example 18 | Example 19 | Example 20 | Example 21 |
|---|---|---|---|---|---|---|
| Compound (1) | Laurylamine (mp: 28° C.) | — | — | — | — | — |
| | Stearylamine (mp: 53° C.) | 0.25 | — | 0.2 | — | — |
| | Cetylamine (fp: 47° C.) | — | — | — | — | — |
| | Oleylamine (fp: 15° C.) | — | 0.2 | — | 0.12 | — |
| | Behenylamine (fp: 55° C to 65° C.) | — | — | — | 0.12 | 0.12 |
| | 3-(Stearylamino)propylamine (mp: 30° C. to 40° C.) | — | — | — | — | — |
| | Distearylamine (mp: 60° C. to 70° C.) | — | — | — | — | — |
| | Dimethylstearylamine (mp: 20° C. to 23° C.) | — | — | 0.2 | — | 0.12 |
| Silicone resin | MQ-1600 | 5 | 10 | 10 | 10 | 10 |
| Amino-modified silicone | SF8417 | — | 0.1 | — | — | — |
| Solvent | MORESCO-WHITE P-40 | 5 | 10 | 10 | 10 | 10 |
| | DOW CORNING TORAY SH 200 FLUID 100 cs | 5 | 10 | 10 | 10 | 10 |
| Non-ionic surfactant | SOFTANOL 50 | 0.38 | 0.75 | 0.75 | 0.75 | 0.75 |
| | SOFTANOL 90 | 0.38 | 0.75 | 0.75 | 0.75 | 0.75 |
| Non-fluorinated acrylic polymer | | 10 | — | — | — | — |
| Aqueous medium | Water | 74.0 | 68.2 | 68.1 | 68.3 | 68.3 |
| Water repellency (polyester) | Washing 0 times (L-0) | 5 | 4-5 | 5 | 4-5 | 4-5 |
| Durable water repellency (polyester) | Washing 10 times (L-10) | 4-5 | 3-4 | 4-5 | 3 | 3 |
| Water repellency (nylon) | Washing 0 time (L-0) | 5 | 5 | 5 | 5 | 5 |
| Durable water repellency (nylon) | Washing 10 times (L-10) | 3-4 | 2-3 | 2-3 | 2-3 | 2-3 |

TABLE 3-continued

| | Example 17 | Example 18 | Example 19 | Example 20 | Example 21 |
|---|---|---|---|---|---|
| Texture (polyester) | 3-4 | 5 | 4 | 4 | 4 |
| Peeling strength (nylon) (N/inch) | 10.8 | 10.5 | 11.0 | 10.7 | 10.8 |
| Seam slippage property (nylon) (mm) | 2.3 | 2.1 | 2.2 | 2.3 | 2.2 |

TABLE 4

| | | Comparative Example 1 | Comparative Example 2 | Comparative Example 3 | Comparative Example 4 | Comparative Example 5 |
|---|---|---|---|---|---|---|
| Compound (1) | Laurylamine (mp: 28° C.) | — | — | — | — | — |
| | Stearylamine (mp: 53° C.) | 0.5 | — | — | — | — |
| | Cetylamine (fp: 47° C.) | — | — | — | — | — |
| | Oleylamine (fp: 15° C.) | — | — | — | — | — |
| | Behenylamine (fp: 55° C to 65° C.) | — | — | — | — | — |
| | 3-(Stearylamino)propylamine (mp: 30° C. to 40° C.) | — | — | — | — | — |
| | Distearylamine (mp: 60° C. to 70° C.) | — | — | — | — | — |
| Silicone resin | MQ-1600 | — | — | 10 | 10 | — |
| Amino-modified silicone | SF8417 | — | — | 2 | — | 30 |
| Solvent | MORESCO-WHITE P-40 | 15 | — | — | 10 | — |
| | DOW CORNING TORAY SH 200 FLUID 100 cs | 15 | — | 20 | 10 | — |
| Non-ionic surfactant | SOFTANOL 50 | 0.75 | — | 0.75 | 0.75 | 0.75 |
| | SOFTANOL 90 | 0.75 | — | 0.75 | 0.75 | 0.75 |
| Non-fluorinated acrylic polymer | | — | 20 | — | — | — |
| Aqueous medium | Water | 68.0 | 80.0 | 66.5 | 68.5 | 68.5 |
| Water repellency (polyester) | Washing 0 times (L-0) | 2 | 4 | 5 | 1 | 1 |
| Durable water repellency (polyester) | Washing 10 times (L-10) | 1 | 2 | 4 | 1 | 1 |
| Water repellency (nylon) | Washing 0 time (L-0) | 2 | 4 | 4-5 | 1 | 1 |
| Durable water repellency (nylon) | Washing 10 times (L-10) | 1 | 2 | 4-5 | 1 | 1 |
| Texture (polyester) | | 3-4 | 2 | 4 | 4 | 5 |
| Peeling strength (nylon) (N/inch) | | 11.2 | 8.2 | 2.1 | 18.3 | 1.5 |
| Seam slippage property (nylon) (mm) | | 6.2 | 8.4 | 2.9 | 2.8 | 12.1 |

It was confirmed that the water-repellent textile products treated with the water repellent agent compositions of Examples 1 to 21 are excellent in water repellency, durable water repellency, texture, and peeling strength and also excellent in seam slippage property.

The invention claimed is:

1. A water repellent agent composition comprising a compound represented by the following General Formula (1) and a silicone resin:

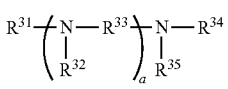

(1)

wherein in Formula (1), $R^{31}$ represents a monovalent hydrocarbon group having 4 to 30 carbon atoms, $R^{32}$ represents a hydrogen, a monovalent hydrocarbon group having 1 to 30 carbon atoms, or an organic group represented by $—R^{36}—N(R^{37})—R^{38}$ (in the formula, $R^{36}$ represents a divalent hydrocarbon group having 1 to 30 carbon atoms, and $R^{37}$ and $R^{38}$ each independently represent a hydrogen or a monovalent hydrocarbon group having 1 to 30 carbon atoms), $R^{33}$ represents a divalent hydrocarbon group having 1 to 30 carbon atoms, one of $R^{34}$ and $R^{35}$ represents hydrogen, an alkyl group with 1 to 22 carbon atoms, or an alkenyl group with 2 to 22 carbon atoms, while another of $R^{34}$ and $R^{35}$ represents hydrogen, a represents an integer of 0 to 2, and when a is 2, the plurality of $R^{32}$ and $R^{33}$ each may be identical or different, and the silicone resin contains MQ, MDQ, MTQ, or MDTQ as a constituent, wherein M, D, T, and Q represent a $(R'')_3SiO_{0.5}$ unit, a $(R'')_2SiO$ unit, a $R''SiO_{1.5}$ unit, and a $SiO_2$ unit, respectively, and wherein R" represents a monovalent aliphatic hydrocarbon group having 1 to 10 carbon atoms or a monovalent aromatic hydrocarbon group having 6 to 15 carbon atoms.

2. The water repellent agent composition according to claim 1, wherein a melting point or freezing point of the compound represented by the above General Formula (1) is 40° C. to 70° C.

3. A method for producing a water-repellent textile product, the method comprising a step of treating fibers with a treatment liquid including the water repellent agent composition according to claim 1.

4. A method for producing a water-repellent textile product, the method comprising a step of treating fibers with a treatment liquid including the water repellent agent composition according to claim 2.

* * * * *